US010181683B2

(12) United States Patent
Endo et al.

(10) Patent No.: US 10,181,683 B2
(45) Date of Patent: Jan. 15, 2019

(54) CONNECTOR AND PRODUCTION METHOD THEREOF

(71) Applicant: DAI-ICHI SEIKO CO., LTD., Kyoto-shi, Kyoto (JP)

(72) Inventors: Takayoshi Endo, Shizuoka (JP); Eiji Kawabe, Shizuoka (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 15/846,907

(22) Filed: Dec. 19, 2017

(65) Prior Publication Data

US 2018/0183191 A1 Jun. 28, 2018

(30) Foreign Application Priority Data

Dec. 22, 2016 (JP) ..... 2016-249196

(51) Int. Cl.
*H01R 9/05* (2006.01)
*H01R 13/6593* (2011.01)
(Continued)

(52) U.S. Cl.
CPC ..... *H01R 13/6593* (2013.01); *H01R 9/05* (2013.01); *H01R 9/0512* (2013.01); *H01R 9/0518* (2013.01); *H01R 13/436* (2013.01); *H01R 13/6596* (2013.01); *H01R 24/38* (2013.01); *H01R 4/183* (2013.01); *H01R 13/11* (2013.01); *H01R 13/506* (2013.01); *H01R 24/60* (2013.01);
(Continued)

(58) Field of Classification Search
CPC .... H01R 13/6593; H01R 13/436; H01R 9/05; H01R 2103/00; H01R 24/38
USPC ..... 439/585, 579, 581
See application file for complete search history.

(56) References Cited

U.S. PATENT DOCUMENTS 3,517,375 A * 6/1970 Mancini ..... H01R 4/646 174/75 C
3,670,293 A * 6/1972 Garver ..... H01R 9/0518 439/585
(Continued)

FOREIGN PATENT DOCUMENTS

EP 1303011 A1 4/2003
EP 2037544 A2 3/2009
(Continued)

OTHER PUBLICATIONS

Extended European Search Report (Application No./Patent No. 17208480.8-1201); dated Mar. 15, 2018.
(Continued)

*Primary Examiner* — Abdullah A Riyami
*Assistant Examiner* — Vladimir Imas
(74) *Attorney, Agent, or Firm* — Howard & Howard Attorneys PLLC

(57) ABSTRACT

A connector includes: an electrically conductive terminal that is crimped and fixed onto an inner conductor of a coaxial cable; a conductive member that is electrically conductive and is crimped and fixed onto an outer conductor of the coaxial cable; an electrically insulative housing that includes a terminal housing chamber housing the terminal and the conductive member; and an electrically conductive top shell to which the conductive member being housed is connected and which is configured as at least one of a ground and a shield.

13 Claims, 26 Drawing Sheets

(51) Int. Cl.

| | |
|---|---|
| ***H01R 13/6596*** | (2011.01) |
| ***H01R 13/436*** | (2006.01) |
| ***H01R 24/38*** | (2011.01) |
| *H01R 4/18* | (2006.01) |
| *H01R 13/11* | (2006.01) |
| *H01R 13/506* | (2006.01) |
| *H01R 24/60* | (2011.01) |
| *H01R 107/00* | (2006.01) |
| *H01R 103/00* | (2006.01) |

(52) U.S. Cl.
CPC ..... *H01R 2103/00* (2013.01); *H01R 2107/00* (2013.01)

(56) References Cited

U.S. PATENT DOCUMENTS

| | | | | |
|---|---|---|---|---|
| 4,897,050 | A * | 1/1990 | Randolph | H01R 9/0518 439/585 |
| 5,293,177 | A | 3/1994 | Sakurai et al. | |
| 5,725,387 | A * | 3/1998 | O'Sullivan | H01R 4/187 439/98 |
| 5,855,493 | A * | 1/1999 | Shelly | H01R 13/516 439/465 |
| 7,371,113 | B2 * | 5/2008 | Burris | H01R 9/0518 439/578 |
| 7,384,306 | B2 * | 6/2008 | Malstrom | H01R 24/50 439/394 |
| 7,607,944 | B2 * | 10/2009 | Yoshioka | H01R 12/598 439/579 |
| 7,632,144 | B2 * | 12/2009 | Sakaguchi | H01R 9/0518 439/585 |
| 8,939,794 | B2 * | 1/2015 | Mason | H01R 9/0515 439/581 |
| 9,362,659 | B2 * | 6/2016 | Jones | H01R 13/516 |
| 9,450,319 | B2 * | 9/2016 | Nishimura | H01R 12/75 |
| 9,610,905 | B2 * | 4/2017 | Choi | B60R 16/023 |
| 9,673,578 | B1 * | 6/2017 | Lane | H01R 4/183 |
| 9,705,266 | B2 * | 7/2017 | Chen | H01R 24/28 |
| 9,761,978 | B2 * | 9/2017 | Kim | H01R 13/14 |
| 2011/0034081 | A1 | 2/2011 | Feldman et al. | |
| 2015/0126062 | A1 | 5/2015 | Kato et al. | |
| 2015/0244115 | A1 | 8/2015 | Yamaguchi et al. | |
| 2018/0019548 | A1 | 1/2018 | Maesoba et al. | |

FOREIGN PATENT DOCUMENTS

| | | | |
|---|---|---|---|
| JP | 64-43570 | U | 3/1989 |
| JP | H04-116366 | U | 10/1992 |
| JP | H07-220823 | A | 8/1995 |
| JP | 2571362 | Y2 | 5/1998 |
| JP | H10162899 | A | 6/1998 |
| JP | 2002-117937 | A | 4/2002 |
| JP | 2006-107992 | A | 4/2006 |
| JP | 2013-232384 | A | 11/2013 |
| JP | 2016-146308 | A | 8/2016 |
| JP | 2016-146309 | A | 8/2016 |
| KR | 20-2008-0000725 | U | 9/2008 |
| WO | 2011/002833 | A1 | 1/2011 |
| WO | 2013/168818 | A1 | 11/2013 |

OTHER PUBLICATIONS

English Translation of Notification of Reasons for Refusal along with Original Notification (KR Patent Application No. 10-2017-0175201); Dispatch Date: Oct. 12, 2018.

English Translation of Notification of Reasons for Refusal along with Original Notification (Japanese Pat. Appln. No. 2016-249196).

* cited by examiner

CONNECTOR AND PRODUCTION METHOD THEREOF

CROSS-REFERENCE TO RELATED APPLICATION

This application claims the benefit of Japanese Patent Application No. 2016-249196, filed on Dec. 22, 2016, the entire disclosure of which is incorporated by reference herein.

FIELD

This application relates to a connector and a production method thereof.

BACKGROUND

Unexamined Japanese Patent Application Kokai Publication No. 2006-107992 discloses a connector for coaxial cables, the connector including a contact connected to the core of a coaxial cable, a ground bar connected to the outer conductor of the coaxial cable, a metal upper shell connected to the ground bar, and a connector housing. In this connector, the ground bar, which is in the form of a metal plate, is connected to the outer conductor of a coaxial cable by means of soldering.

Concerning the connector described in Unexamined Japanese Patent Application Kokai Publication No. 2006-107992, the step of connecting the ground bar to the outer conductor of a coaxial cable includes soldering. As a result, the work efficiency in the whole step of assembling a connector is decreased. Therefore, improved work efficiency is desired.

The present disclosure has been created under the foregoing circumstances, and an objective of the disclosure is to provide a connector and a production method thereof that can improve the work efficiency in the step of assembling a connector.

SUMMARY

To achieve the above-described objective, a connector according to a first exemplary aspect of the present disclosure includes:

an electrically conductive first terminal that is crimped and fixed onto an inner conductor of a coaxial cable;

an electrically conductive first conductive member that is crimped and fixed onto an outer conductor of the coaxial cable;

an electrically insulative housing that includes a first housing chamber housing the first terminal and the first conductive member; and an electrically conductive first shell to which the first conductive member being housed is connected and which is configured as at least one of a ground and a shield.

In the first conductive member, a first protrusion that comes into contact with the first shell may be disposed; and a first support hole may be formed in the first shell, the first support hole supporting the first conductive member with the first protrusion fitted into the first support hole.

The first terminal may have a shape extending from a joint portion where a counterpart terminal is connected to a crimp portion where the terminal is crimped onto the coaxial cable; and the first protrusion may protrude in a direction being orthogonal to the direction in which the first terminal extends.

The first conductive member may include an electrically conductive plate material, which is wrapped around the outer conductor of the coaxial cable, and a pair of ends of which are put together and protrude from the outer conductor; and the first protrusion may include a portion where the pair of ends are put together.

The first conductive member may include an electrically conductive plate material, which is wrapped around the outer conductor of the coaxial cable, and one end of which protrudes from the outer conductor; and the first protrusion may include a portion where the one end protrudes.

The connector may include an electrically conductive second shell that is configured as at least one of a ground and a shield.

In the first conductive member, a second protrusion that comes into contact with the second shell may be disposed;

a second support hole may be formed in the second shell, the second support hole supporting the first conductive member with the second protrusion fitted into the second support hole; and the first conductive member may be connected to the second shell with the second protrusion fitted into the second support hole.

The connector may include:

an electrically conductive second terminal that is crimped and fixed onto an inner conductor of another coaxial cable;

an electrically conductive second conductive member that is crimped and fixed onto an outer conductor of the other coaxial cable; and an electrically conductive second shell to which the second conductive member is connected and which is configured as at least one of a ground and a shield, wherein the housing may be formed into a plate-like shape including a first face on which the first housing chamber is disposed and a second face being opposite to the first face, and the housing may include a second housing chamber on the second face, the second housing chamber housing the second terminal and the second conductive member.

The connector may include an electrically conductive third shell to which the first conductive member and the second conductive member are connected and which is configured as a ground.

In the first conductive member, a second protrusion that comes into contact with the third shell may be disposed; and a third support hole may be formed in the third shell, the third support hole supporting the first conductive member with the second protrusion fitted into the third support hole.

The first conductive member may include an electrically conductive plate material, which is wrapped around the outer conductor of the coaxial cable and which includes two tongue-like cuts; and the second protrusion may be formed by putting together ends of raised tongue-like portions.

The third shell may be press-fitted into the housing and fixed in the housing.

A method for producing a connector according to a second aspect of the present disclosure includes:

a terminal crimping step of crimping and fixing an electrically conductive first terminal onto an inner conductor of a coaxial cable;

a conductive member crimping step of crimping and fixing an electrically conductive first conductive member onto an outer conductor of the coaxial cable;

a housing step of housing the first terminal and the first conductive member into a first housing chamber of a housing that includes an electrically conductive third shell configured as a ground; and a ground connecting step of connecting the first conductive member to the third shell.

In the conductive member crimping step, a first protrusion that comes into contact with an electrically conductive first shell configured as at least a shied may be formed in the first conductive member.

A first support hole may be formed in the first shell, the first support hole supporting the first conductive member with the first protrusion fitted into the first support hole;

the first terminal may have a shape extending from a joint portion where a counterpart terminal is connected to a crimp portion where the terminal is crimped onto the coaxial cable;

the first protrusion may protrude in a direction being orthogonal to the direction in which the first terminal extends; and in the ground connecting step, the first protrusion may be fitted into the first support hole, with the first protrusion and the first support hole being moved relative to each other in the orthogonal direction.

BRIEF DESCRIPTION OF THE DRAWINGS

A more complete understanding of this application can be obtained when the following detailed description is considered in conjunction with the following drawings, in which.

DETAILED DESCRIPTION

Embodiment 1

A connector 10 and a production method thereof according to Embodiment 1 of the present disclosure will now be described with reference to FIGS. 1 to 23. For ease of understanding, XYZ coordinates are applied to the figures and referred to as appropriate.

Figure 1:
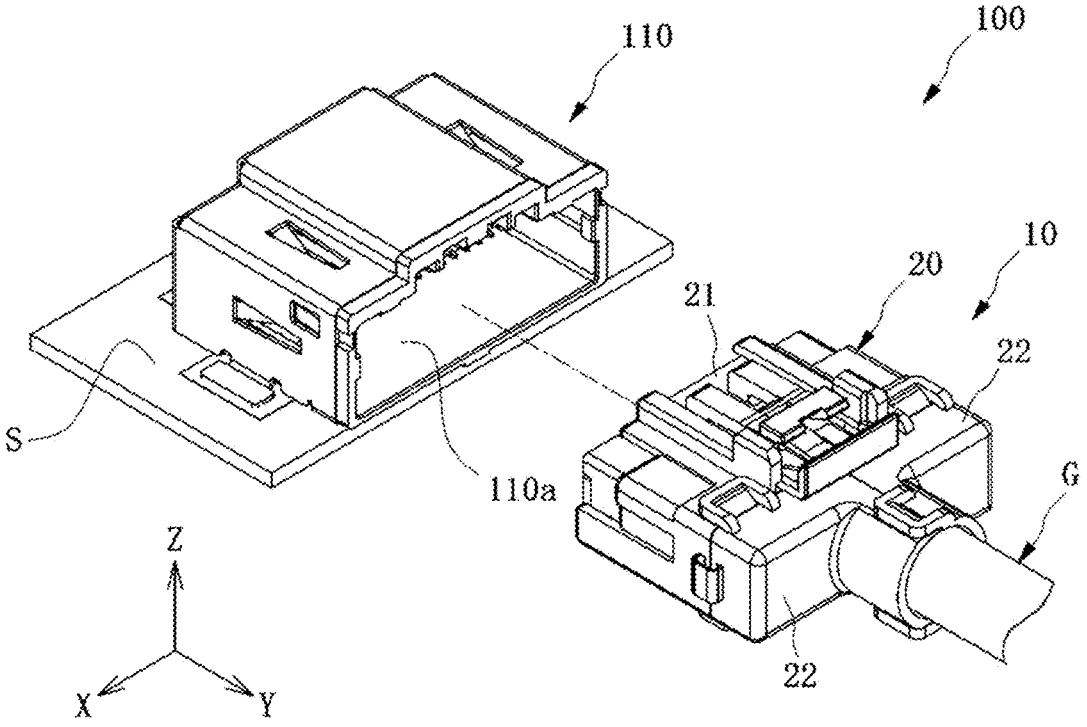
FIG. 1 is an exploded perspective view of a connector unit according to Embodiment 1 of the present disclosure.

The connector 10 may be used, for example, in a connector unit 100 for connection between electronic circuit components installed in a car. The connector unit 100 is a car-mounted connector unit, which means it is used in an environment with significant temperature changes or higher-frequency vibrations. As illustrated in FIG. 1, the connector unit 100 includes the connector 10 according to the Embodiment 1 and a counterpart connector 110.

The counterpart connector 110 is to be fitted to the connector 10. The counterpart connector 110 includes a counterpart housing made of an electrically insulative material and a counterpart terminal formed of a male terminal.

The counterpart housing is a member in a substantially box shape, in which a fitting hole 110*a* being open on the +Y side is formed. The connector 10 is to be inserted into the fitting hole 110*a* in the counterpart housing. A engaged part is formed in the counterpart housing so as to engage and fasten the connector 10 inside the fitting hole 110*a*.

The counterpart terminal includes a male terminal made of an electrically conductive material. One end of the counterpart terminal protrudes into an internal space of the fitting hole 110*a* in the counterpart housing. The other end of the counterpart terminal protrudes from the rear end face of the counterpart housing, bends in a substantially S shape, and connects with a wiring substrate S.

Figure 2:
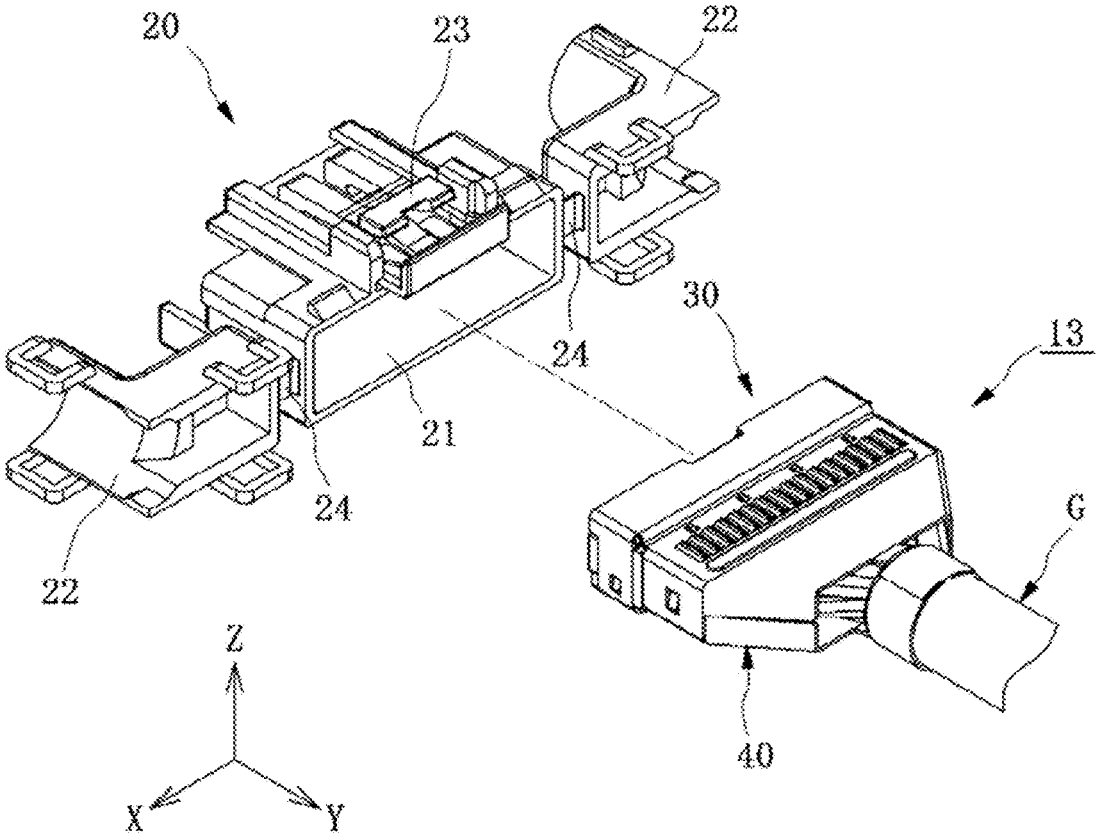
FIG. 2 is an exploded perspective view (part 1) of a connector.
Figure 3:
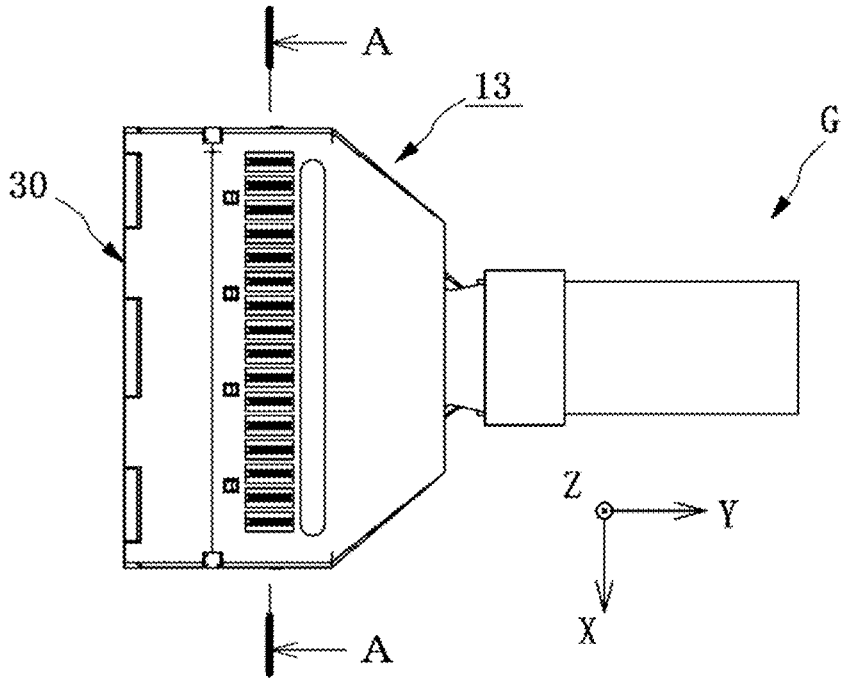
FIG. 3 is a plan view of the connector separated from an outer housing.
Figure 4:
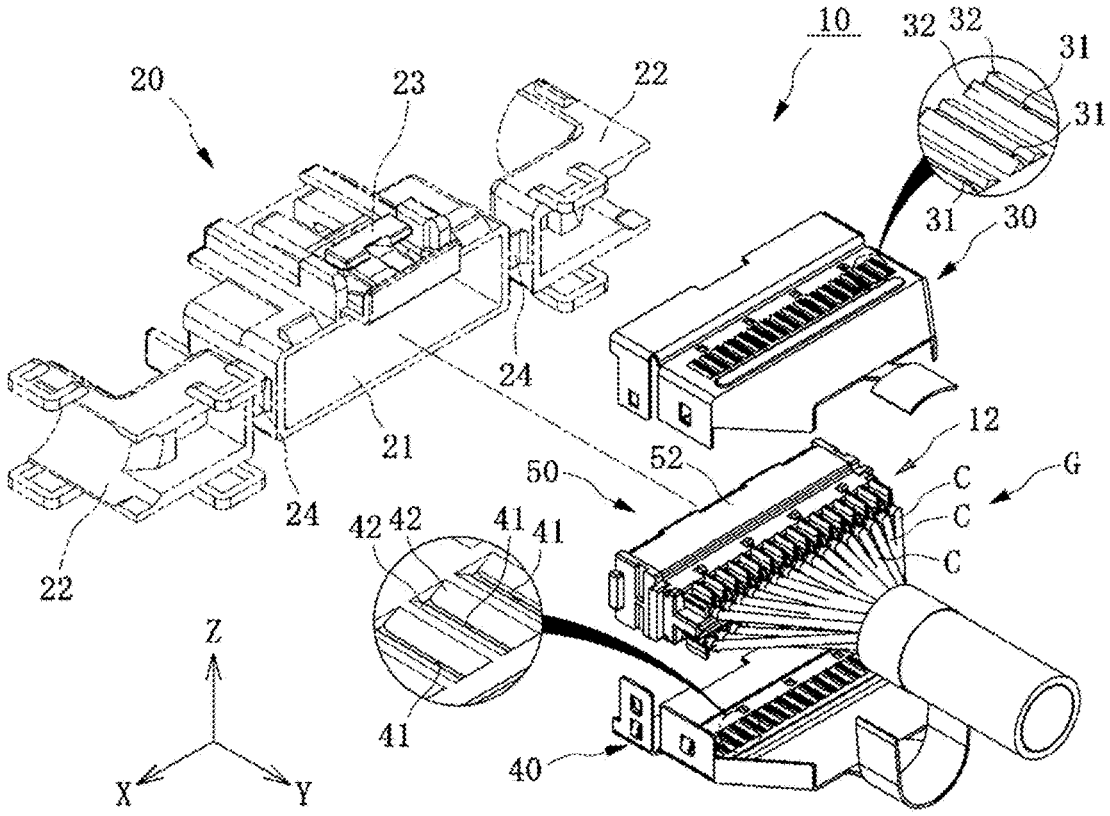
FIG. 4 is an exploded perspective view (part 2) of the connector.

As seen in FIGS. 2 to 4, a plurality of coaxial cables C is tied into a cables group G and connected to the connector 10.

Figure 5:
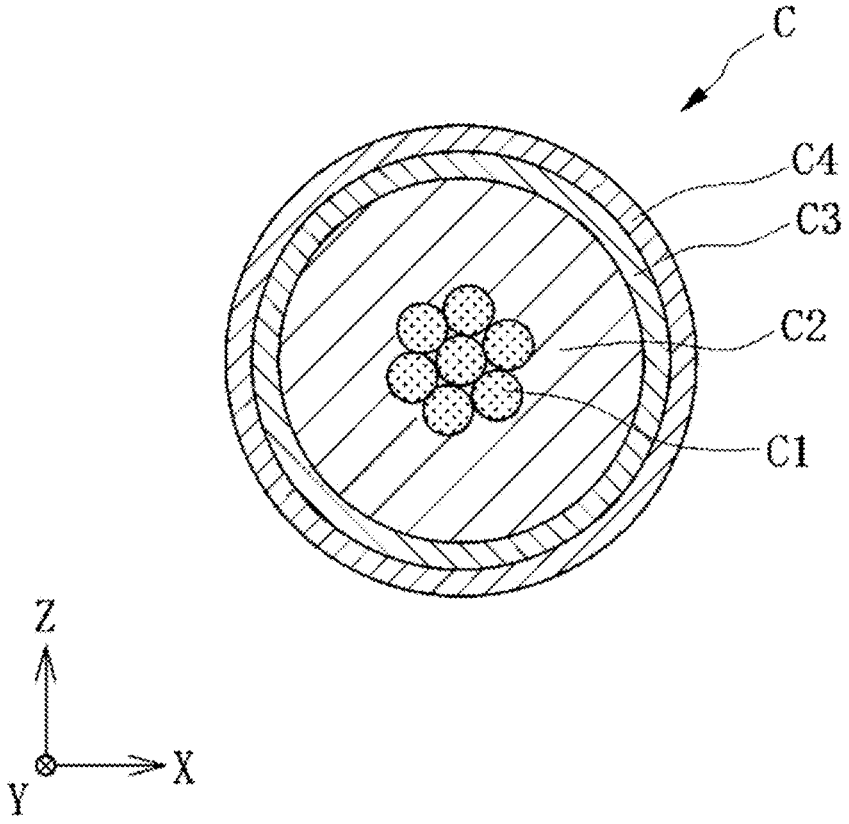
FIG. 5 is an XZ cross-sectional view of a coaxial cable.

As illustrated in FIG. 5, for example, the coaxial cable C includes an inner conductor C1 made of a plurality of copper wires, an electrically insulative dielectric C2, an outer conductor C3 made of copper wires braided around the dielectric C2, and an insulator C4 made of an electrically insulative material, all of which are formed into layers.

Referring back to FIG. 4, the connector 10 includes an outer housing 20, which covers a sub-assembly 12 that includes the cables group G, a top shell 30 (first shell), and a bottom shell 40 (second shell).

The outer housing 20, which is a case made of an electrically insulative material such as a resin, protects internal components of the connector 10. The outer housing 20 includes an outer housing body 21 and a pair of cable covers 22. On the outer housing body 21, there are formed an engaging part to engage with the engaged part on the counterpart housing and a disengaging part 23 provided for disengaging the engaging part. Each cable cover 22 is rotatably attached to the outer housing body 21 via a hinge 24.

The top shell 30 (first shell), which is made of an electrically conductive material such as metal, is formed as a ground and shield. Support holes 31 (first support holes) are formed in the top shell 30. Multiple support holes 31, each of which is a rectangular hole whose longitudinal direction is along the Y-axis direction, are placed at equal spaces along the X-axis direction. On the support hole 31, a pair of resilient pieces 32 protruding from a hole edge and tilting upward while facing each other are formed.

The bottom shell 40 (second shell), which is made of an electrically conductive material such as metal, is formed as a ground and shield. Multiple support holes 41 are formed on the bottom shell 40. The support holes 41, each of which is a rectangular hole whose longitudinal direction is along the Y-axis direction, are placed at equal spaces along the X-axis direction. On the support hole 41, a pair of resilient pieces 42 protruding from a hole edge and tilting downward while facing each other are formed.

Figure 6:
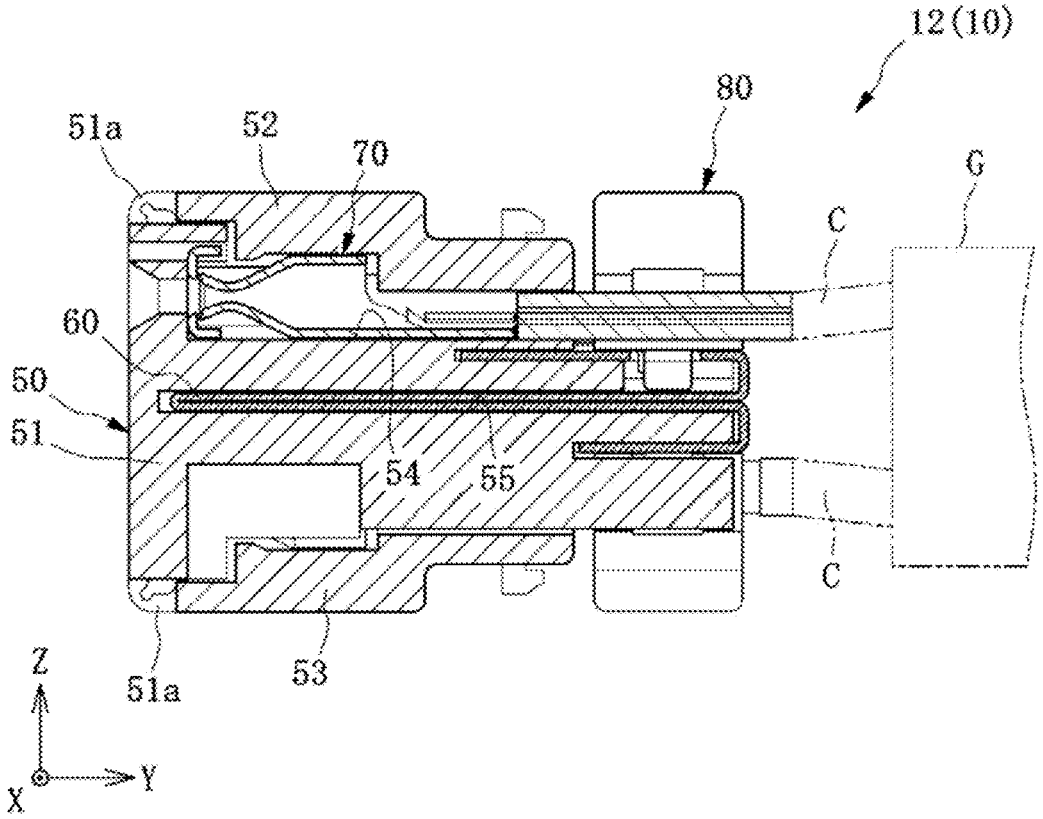
FIG. 6 is a YZ cross-sectional view of the connector (sub-assembly), taken along B-B in FIG. 8.
Figure 7:
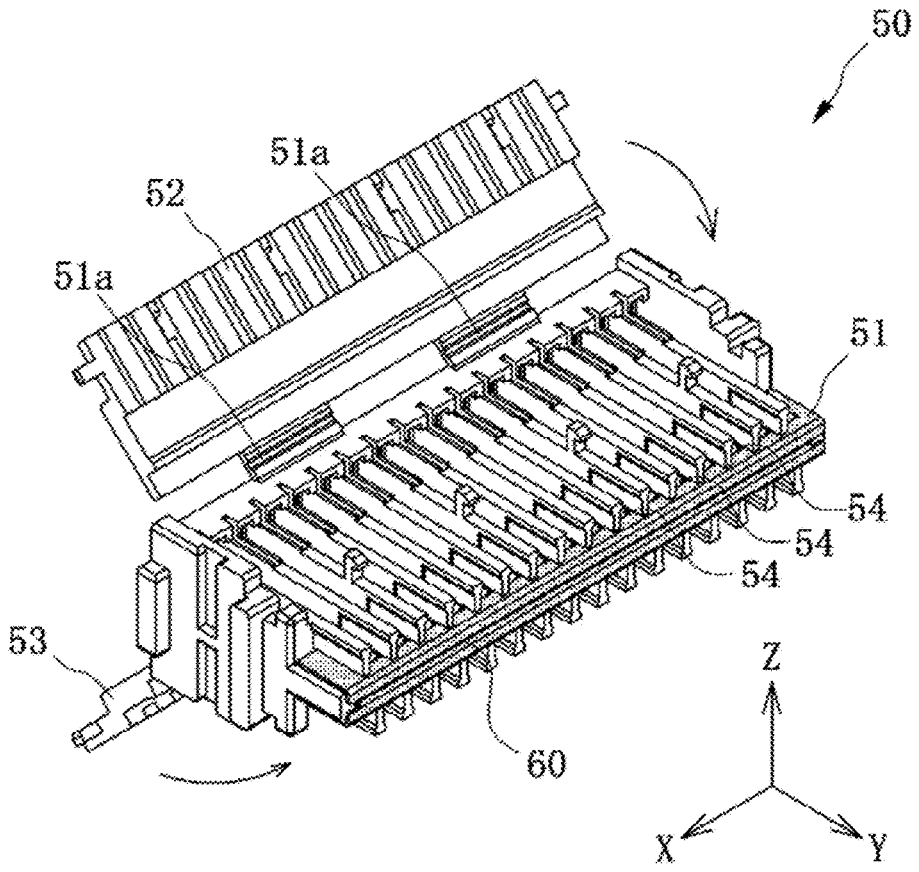
FIG. 7 is a perspective view of an inner housing and a center shell.

As illustrated in FIG. 6, the connector 10 includes, in addition to the above-described members, an inner housing 50 (housing) made of an electrically insulative material such as a resin, a center shell 60 (third shell), a plurality of terminals 70, and a plurality of conductive members 80. Note that the aforementioned sub-assembly 12 includes the inner housing 50, the center shell 60, the terminals 70, the conductive members 80, and the cables group G. In FIG. 7, the center shell 60 is depicted by hatching.

With reference to FIG. 7, the inner housing 50 (housing) is made of an electrically insulative material such as a resin. The inner housing 50 includes an inner housing body 51 and an upper cover 52 and a lower cover 53 that are rotatably attached to the inner housing body 51 via a hinge 51*a*. The upper cover 52 and the lower cover 53 each rotate around a rotation axis of the hinge 51*a* running parallel to the X-axis direction.

Figure 8:
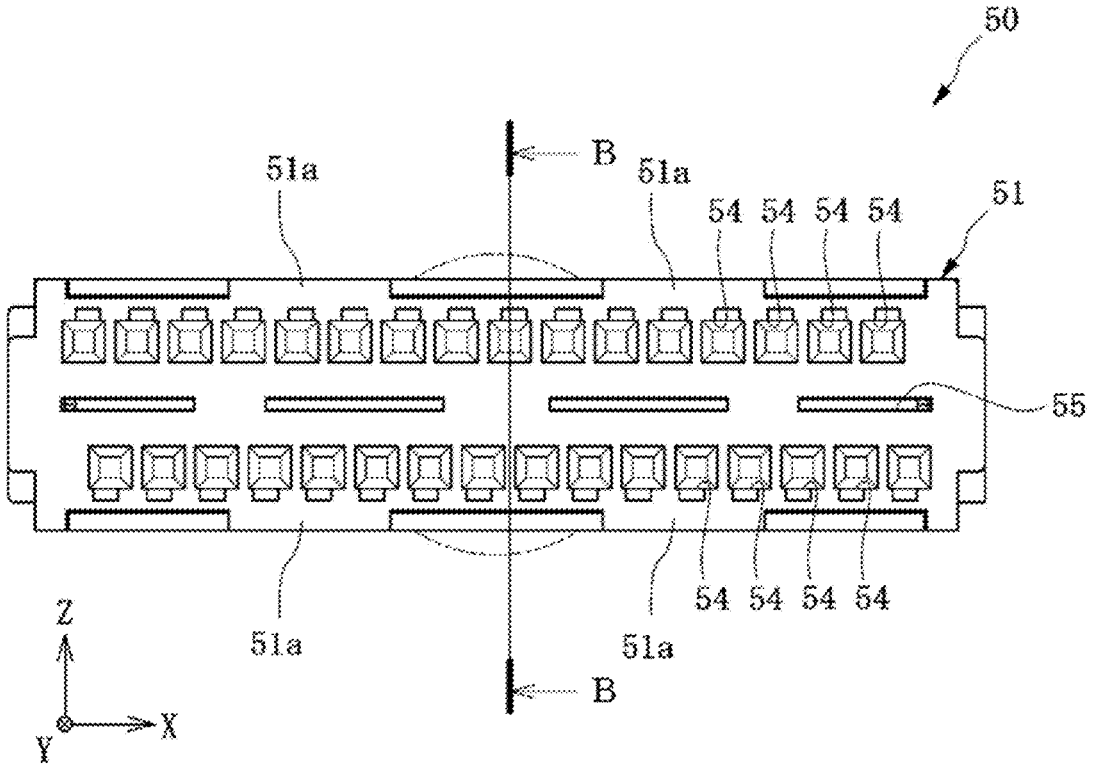
FIG. 8 is a front view of the inner housing.

As illustrated in FIG. 8, in the inner housing body 51, thirty-two terminal housing chambers 54 in total arranged in two rows and sixteen columns and a center shell housing chamber 55 are formed. The terminal housing chambers 54, which are formed of the same size, are made up of upper sixteen terminal housing chambers 54 (first housing chambers) formed on the upper face (first face) of the inner housing body 51 and lower sixteen terminal housing chambers 54 (second housing chambers) formed on the lower face (second face) of the inner housing body 51. The upper terminal housing chambers 54 are shifted from the lower terminal housing chambers 54 along the X-axis direction. As seen in FIG. 7, the upper terminal housing chambers 54 are partially covered by the upper cover 52. The lower terminal housing chambers 54 (second housing chambers) are disposed so as to be upside down relative to the upper terminal housing chambers 54. The lower terminal housing chambers 54 are partially covered by the lower cover 53.

Figure 9:
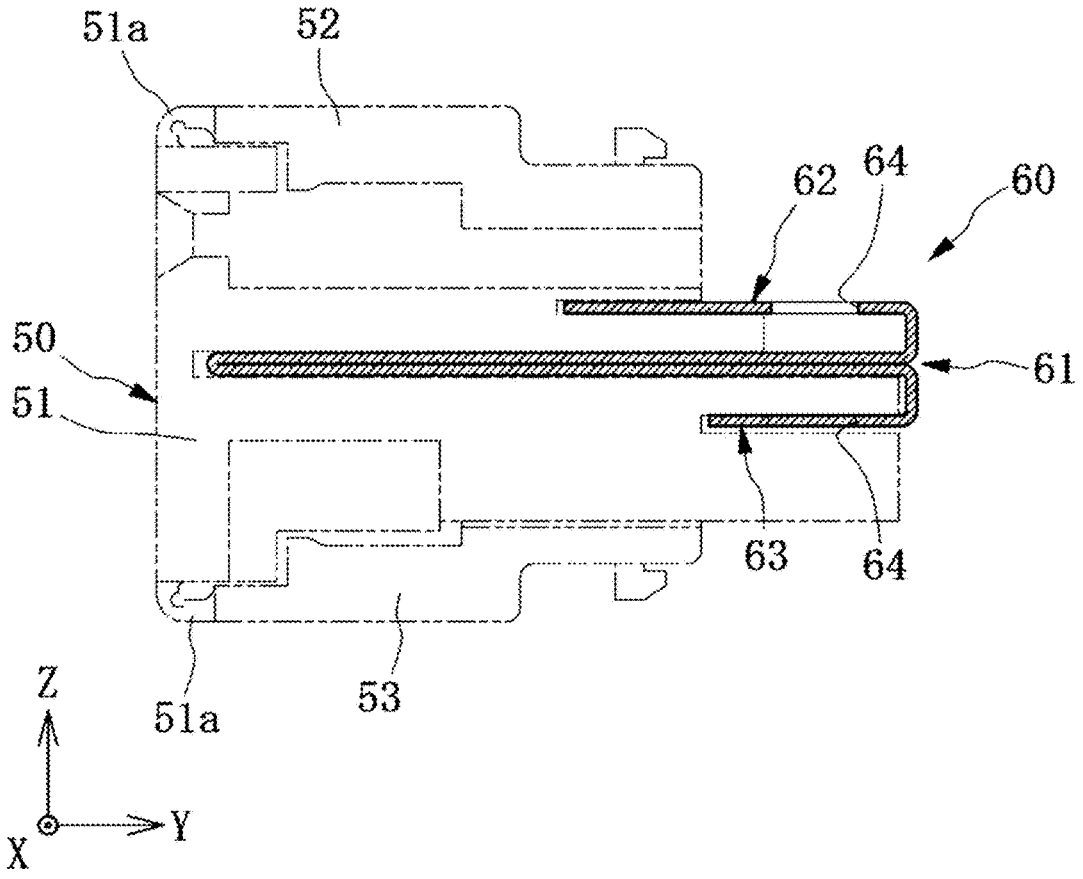
FIG. 9 is a YZ cross-sectional view of the center shell and others.
Figure 10:
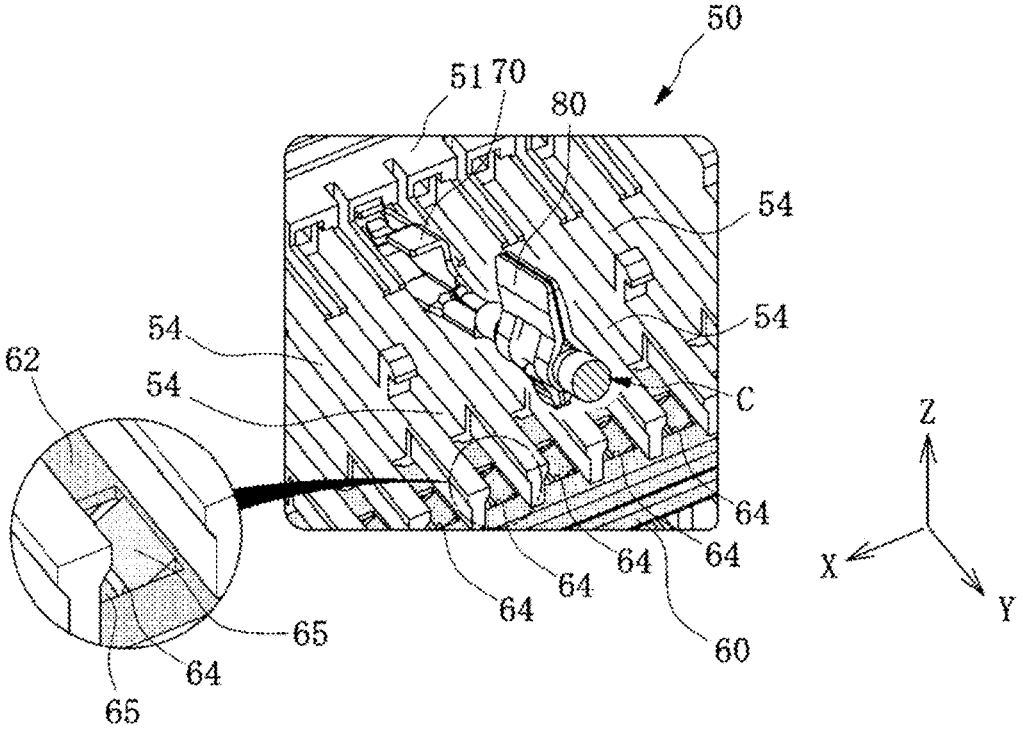
FIG. 10 is a perspective view of the inner housing seen from an upper point, intended to explain support holes in the center shell.

The center shell 60 (third shell), which is made of an electrically conductive material such as metal, is formed as a ground. As illustrated in FIG. 9, the center shell 60 of the Embodiment 1 includes a base end 61, an upper ground 62, and a lower ground 63, and is formed by bending a metal plate. The center shell 60 is press-fitted into the center shell housing chamber 55 in the inner housing 50 from the +Y side to be fixed inside the center shell housing chamber 55. As illustrated in FIG. 10, a plurality of support holes 64 are formed on the upper ground 62 of the center shell 60. Likewise, a plurality of support holes 64 are formed on the lower ground 63. The support hole 64, which is disposed on every terminal housing chamber 54, constitutes part of the bottom of the terminal housing chamber 54 formed in the inner housing 50. On the support hole 64, a pair of resilient pieces 65 protruding from a hole edge and facing each other are formed. In FIG. 10, the center shell 60 is depicted by hatching.

Figure 11:
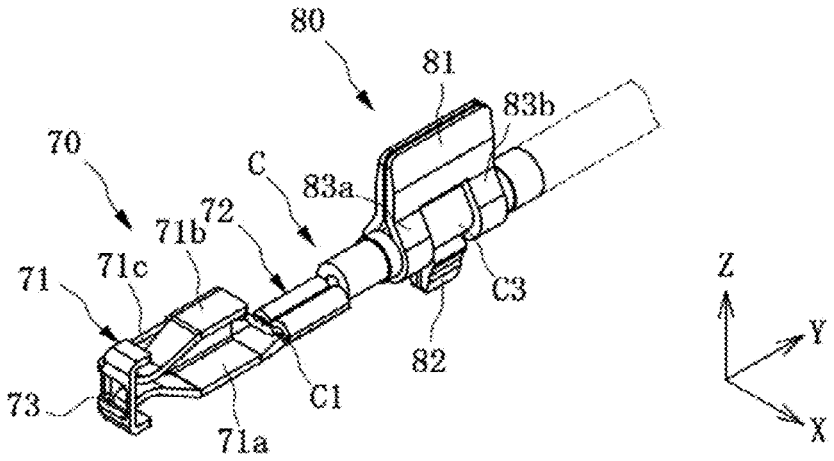
FIG. 11 is a perspective view (part 1) of a terminal, a conductive member, and a tip of the connector.

With reference to FIG. 11, a terminal 70 is crimped and fixed onto the inner conductor C1 of the coaxial cable C. The terminal 70 is formed by bending an electrically conductive plate material made from copper, a copper alloy, or the like. The terminal 70, which is a female terminal extending in the Y-axis direction, is connected to the counterpart terminal, which is a male terminal. The connector 10 according to the Embodiment 1 includes thirty-two terminals 70 arranged in two rows. The number of terminals 70 is the same as that of the terminal housing chambers 54 formed in the inner housing 50. The terminal 70 includes a body 71 and a crimp fixing part 72.

The body 71, which includes a bottom plate 71*a*, a top plate 71*b*, and a side plate 71*c*, is formed into a substantially rectangular tube having an opening 73 (connection) into which the counterpart terminal is to be inserted. Spring contacts in a convex shape and facing each other are formed on the bottom and top plates 71*a* and 71*b*. In the Embodiment 1, the body 71 is formed into a substantially rectangular tube having the opening 73. However, the shape is not limited to this and the body 71 may be formed into a shape other than a substantially rectangular tube.

The crimp fixing part 72 is used for swaging the terminal onto the inner conductor C1 of the coaxial cable C. The crimp fixing part 72 is crimped onto the inner conductor C1 of the coaxial cable C through swaging so that electrical connection is established.

The terminal 70 configured as above has a shape extending from the opening 73, which is a connection to the counterpart terminal, to the crimp fixing part 72 where the terminal 70 is crimped onto the coaxial cable C. The terminal 70 extends in a direction parallel to the Y-axis direction. A first protrusion 81 protrudes in the Z-axis direction, which is orthogonal to the direction in which the terminal 70 extends.

Figure 12:
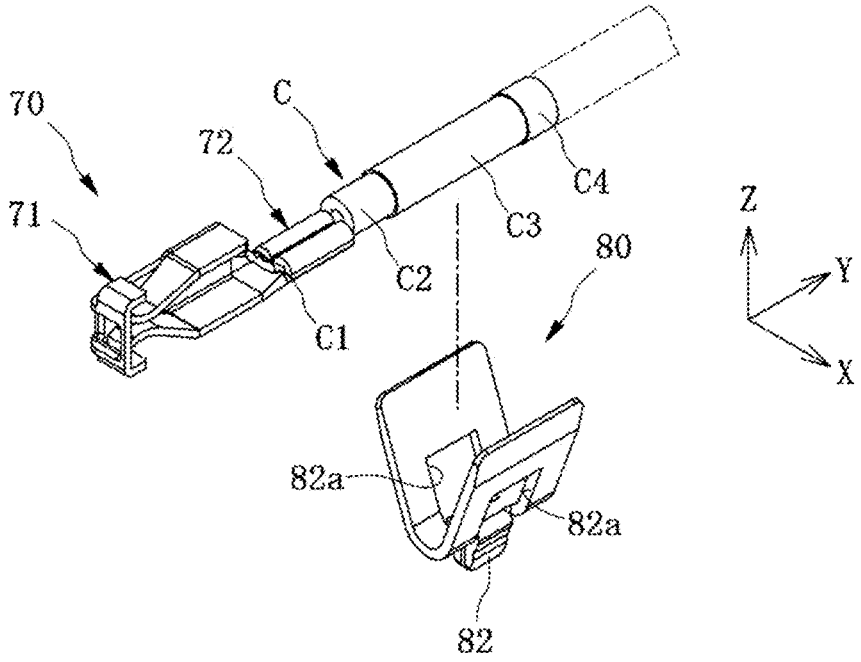
FIG. 12 is a perspective view (part 2) of the terminal, the conductive member, and the tip of the connector.

As illustrated in FIGS. 11 and 12, the conductive member 80 is a metal crimp terminal to be crimped and fixed onto the outer conductor C3 of the coaxial cable C. The conductive member 80, which is formed by bending an electrically conductive plate material made from copper, a copper alloy, or the like, is wrapped around the outer conductor C3 of the coaxial cable C and a pair of ends of the plate material are put together to protrude from the outer conductor C3. The connector 10 according to the Embodiment 1 includes thirty-two conductive members 80, the number being the same as that of the terminal housing chambers 54 formed in the inner housing 50. The conductive member 80 includes a first protrusion 81 to come into contact with either the top shell 30 or the bottom shell 40 and a second protrusion 82 to come into contact with the center shell 60. The first and second protrusions 81 and 82 protrude in the Z-axis direction, which is orthogonal to the direction in which the terminal 70 extends.

The first protrusion 81 is formed by putting together a pair of plate-like ends of the conductive member 80 that is not attached to the outer conductor C3 yet. The second protrusion 82 is formed by making a pair of tongue-like cuts 82*a* in the plate-like conductive member 80, and by raising the pair of tongue-like portions so that the portions face each other and putting them together. The tongue-like cut 82*a* may be U-shaped or may be in the shape of a rectangle or triangle.

Figure 13:
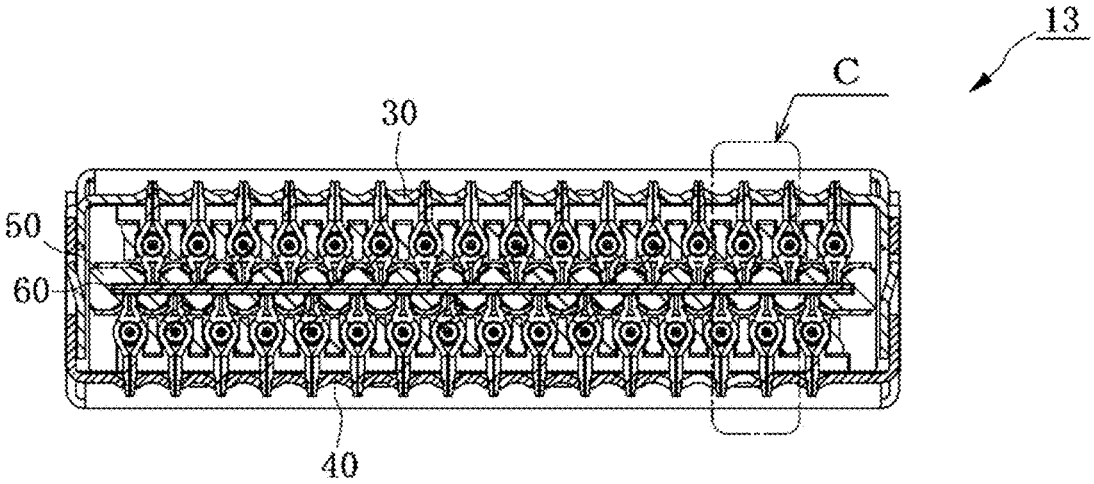
FIG. 13 is an XZ cross-sectional view of the connector, taken along A-A in FIG. 3.
Figure 14:
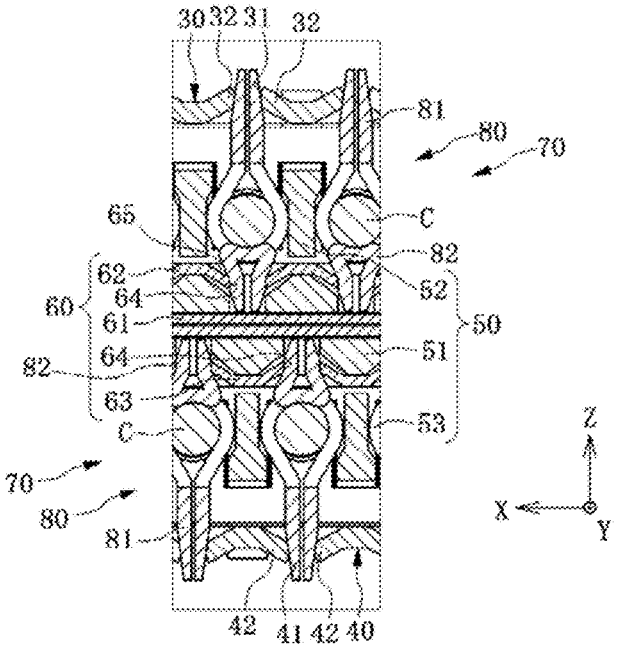
FIG. 14 is an enlarged view of the area pointed by the arrow C in FIG. 13.

As illustrated in FIGS. 13 and 14, the first protrusion 81 is formed to protrude in the Z-axis direction (in the +Z or −Z direction). Specifically, the conductive member 80 disposed in the upper row has the first protrusion 81 protruding in the +Z direction, while the conductive member 80 disposed in the lower row has the first protrusion 81 protruding in the −Z direction. The first protrusion 81 is supported by the top shell 30 or the bottom shell 40 with the first protrusion 81 fitted into the support hole 31 in the top shell 30 or into the support hole 41 in the bottom shell 40. Resilient pieces 32 and 42 are protruding from an edge of the support holes 31 and 41 to come into contact with the first protrusion 81 fitted into either the support hole 31 or 41, allowing electrical continuity to be established. As a result, the conductive member 80 is connected to the top shell 30 or the bottom shell 40, allowing electrical continuity to be established.

The second protrusion 82 is formed to protrude in the Z-axis direction (in the +Z or −Z direction). Specifically, the conductive member 80 disposed in the upper row has the second protrusion 82 protruding in the −Z direction, while the conductive member 80 disposed in the lower row has the second protrusion 82 protruding in the +Z direction. The second protrusion 82 is supported by the center shell 60 with the second protrusion 82 fitted into the support hole 64 in the center shell 60. Resilient pieces 65 are protruding from an edge of the support hole 64 to come into contact with the second protrusion 82 fitted into the support hole 64, allowing electrical continuity to be established.

As illustrated in FIG. 11, the conductive member 80 is crimped and fixed onto the outer conductor C3 of the coaxial cable C with two crimp portions 83*a* and 83*b*.

As seen in FIG. 14, the terminal 70 (second terminal) and the conductive member 80 (second conductive member) housed in the terminal housing chamber 54 in the lower row are disposed so as to be upside down relative to the terminal 70 (first terminal) and the conductive member 80 (first conductive member) housed in the terminal housing chamber 54 in the upper row.

A method of producing the connector 10 as configured above will now be described with reference to FIGS. 15 to 23.

(Step of Crimping Terminal)

Figure 15:
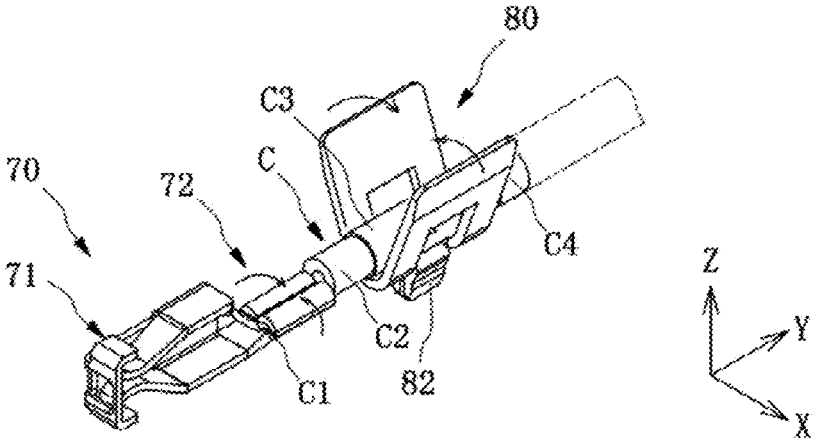
FIG. 15 is a drawing (part 1) intended to explain steps of producing the connector.

First, the terminal 70 is swaged to be crimped and fixed onto the inner conductor C1 of the coaxial cable C as illustrated in FIG. 15. Through the terminal crimping step, the terminal 70 is electrically connected to the inner conductor C1 of the coaxial cable C. The same terminal crimping step is performed on every coaxial cable C that is to be connected to the connector 10.

(Step of Crimping Conductive Member)

Next, the conductive member 80 is swaged to be crimped and fixed onto the outer conductor C3 of the coaxial cable C. During the crimping and fixing, the first and second protrusions 81 and 82 are also formed. Through the conductive member crimping step, the conductive member 80 is electrically connected to the outer conductor C3 of the coaxial cable C. The same conductive member crimping step is performed on every coaxial cable C that is to be connected to the connector 10.

(Step of Attaching Center Shell 60)

Then, the center shell 60 is press-fitted into the center shell housing chamber 55 in the inner housing 50 from the +Y side to be fixed inside the center shell housing chamber 55.

(Step of Housing and Connecting Ground)

Figure 16:
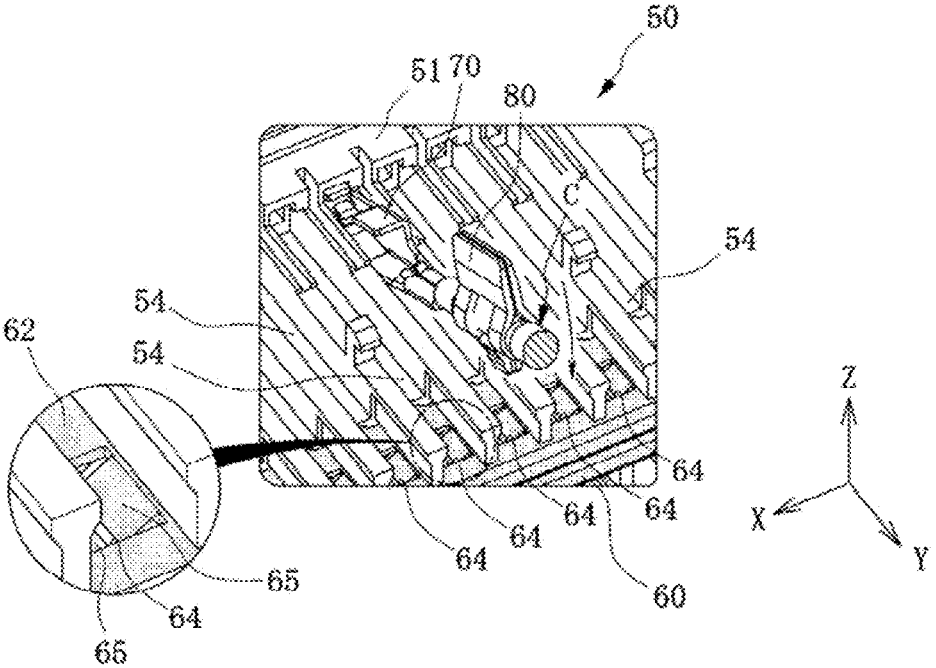
FIG. 16 is a drawing (part 2) intended to explain steps of producing the connector.

Next, as illustrated in FIG. 16, the terminal 70 and the conductive member 80 that have been swaged onto the tip of the coaxial cable C are housed into an upper terminal housing chamber 54 in the inner housing body 51 of the inner housing 50. Additionally, the terminal 70 and the conductive member 80 that have been swaged on the tip of the coaxial cable C are housed into a lower terminal housing chamber 54.

Figure 17:
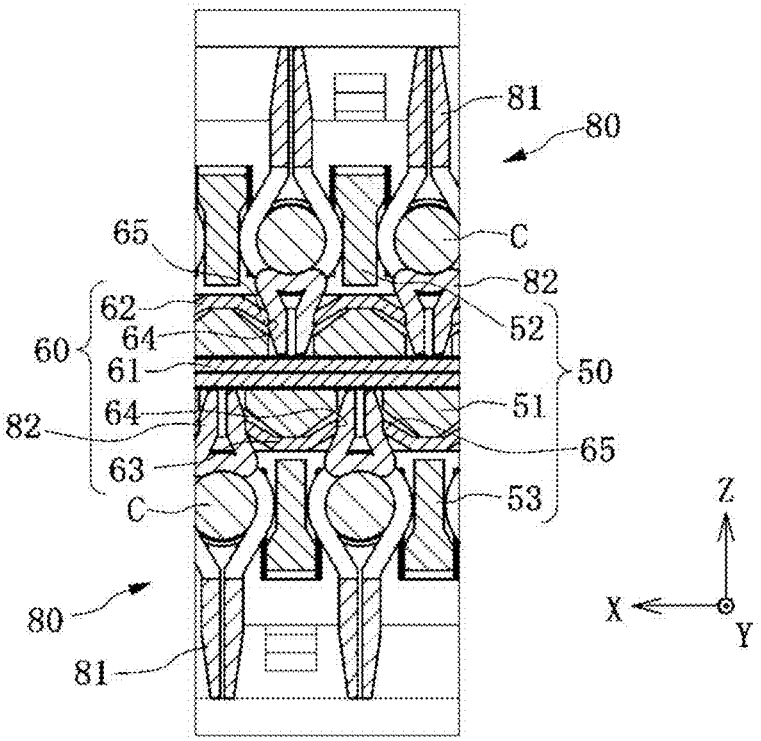
FIG. 17 is a drawing (part 3) intended to explain steps of producing the connector.
Figure 18:
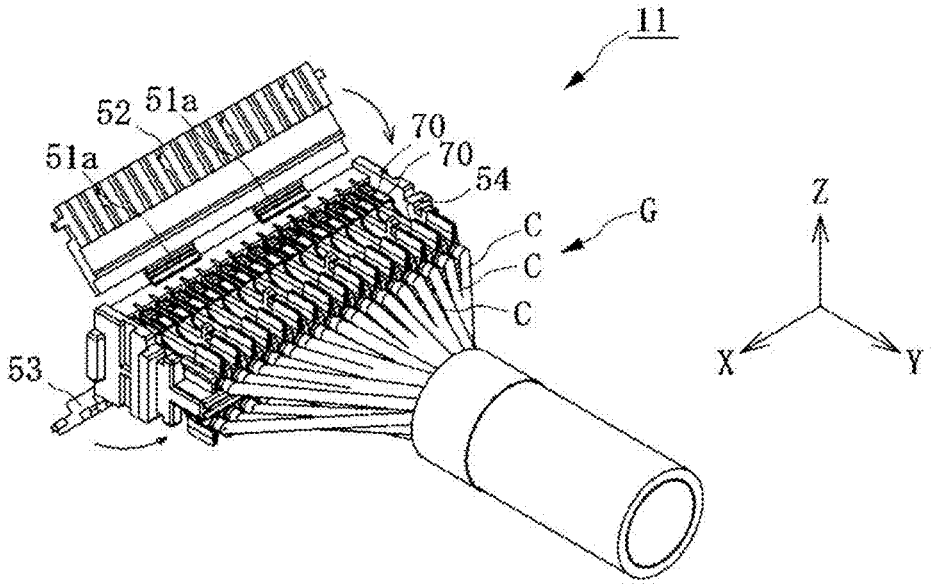
FIG. 18 is a drawing (part 4) intended to explain steps of producing the connector.
Figure 19:
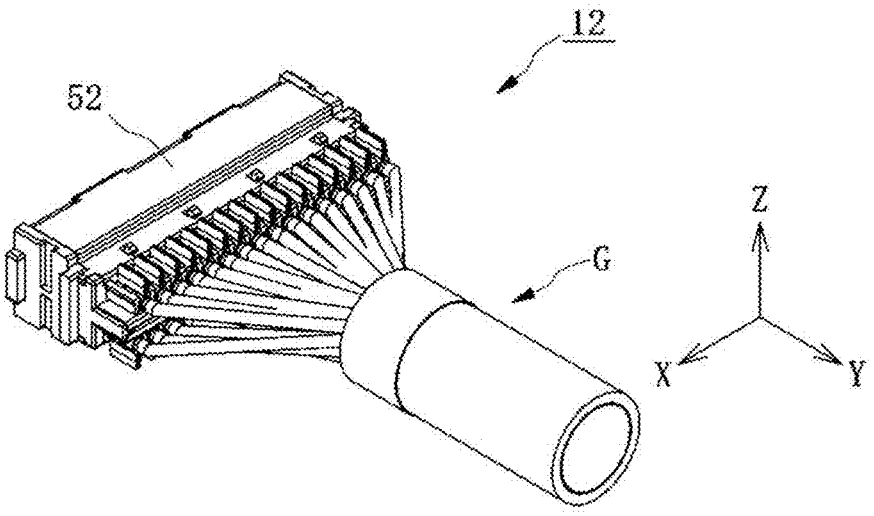
FIG. 19 is a drawing (part 5) intended to explain steps of producing the connector.

As illustrated in FIG. 17, when the terminal 70 and the conductive member 80 have been housed into a terminal housing chamber 54, the conductive member 80 is connected to the center shell 60, which is configured as a ground. Specifically, the second protrusion 82 is moved in the Z-axis direction to be fitted into the support hole 64 in the center shell 60. As a result, the second protrusion 82 comes into contact with the resilient pieces 65 protruding from an edge of the support hole 64, allowing electrical continuity to be established. Through the housing and ground connecting step, the conductive member 80 is electrically connected to the center shell 60, with the result that the outer conductor C3 of the coaxial cable C is electrically connected to the center shell 60. The same housing and ground connecting step is performed on every coaxial cable C that is to be connected to the connector 10. The sub-assembly 11 depicted in FIG. 18, in which each terminal 70 is fixed in every pole, is now obtained.

(Step of Rotating Upper Cover 52 on Hinge)

Next, the upper cover 52 is rotated on a rotation axis of the hinge 51*a* of the inner housing body 51 to partially cover the upper terminal housing chambers 54. The upper cover 52 is configured to be a top plate for the terminal housing chambers 54 and to catch the terminals 70. Being caught by the upper cover 52, the terminals 70 are held in the terminal housing chambers 54 while retained in the inner housing body 51.

(Step of Rotating Lower Cover 53 on Hinge)

Next, the lower cover 53 is rotated on a rotation axis of the hinge 51*a* of the inner housing body 51 to partially cover the lower terminal housing chambers 54. In this way, the lower cover 53 is configured to be a bottom plate for the terminal housing chambers 54 and to catch the terminals 70. Being caught by the lower cover 53, the terminals 70 are held in the terminal housing chambers 54 while retained in the inner housing body 51. After the steps of rotating on the hinge, the sub-assembly 12 illustrated in FIG. 19, in which the upper and lower covers 52 and 53 are closed, is obtained.

(Step of Attaching Top Shell 30)

Figure 20:
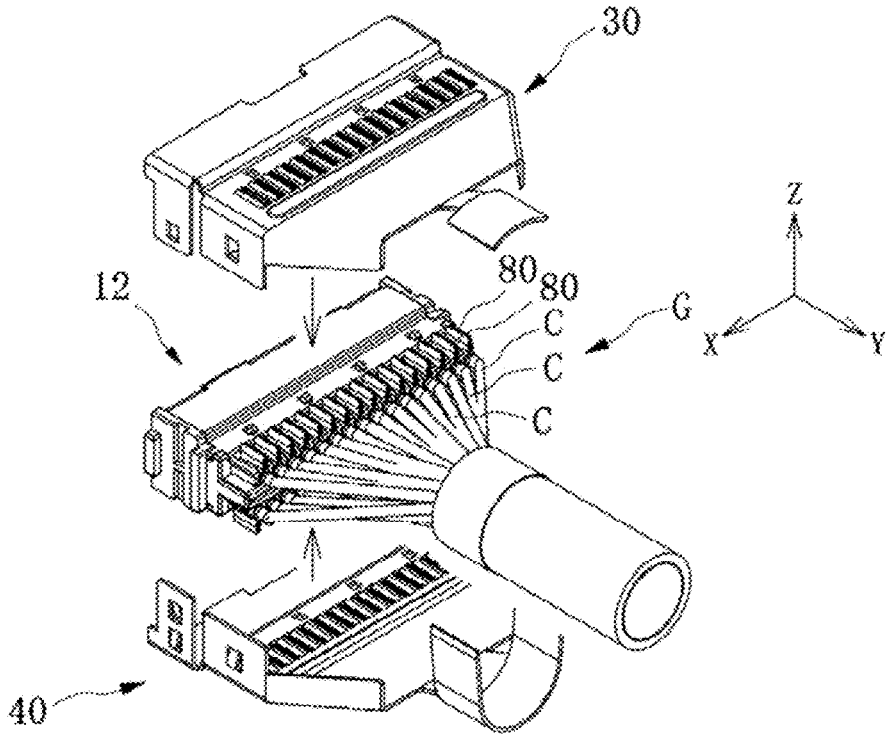
FIG. 20 is a drawing (part 6) intended to explain steps of producing the connector.
Figure 21:
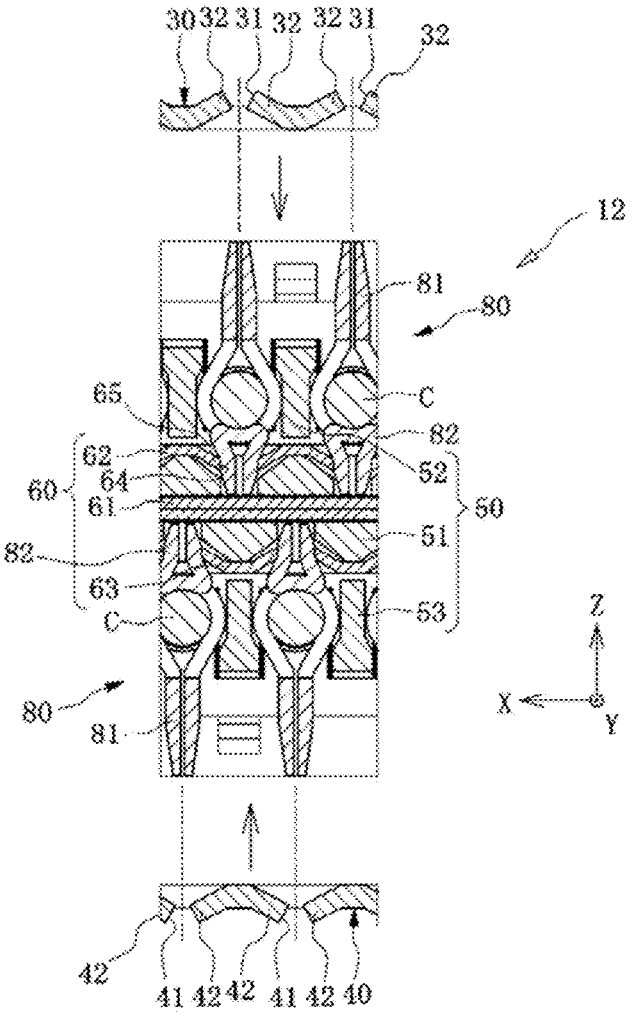
FIG. 21 is a drawing (part 7) intended to explain steps of producing the connector.
Figure 22:
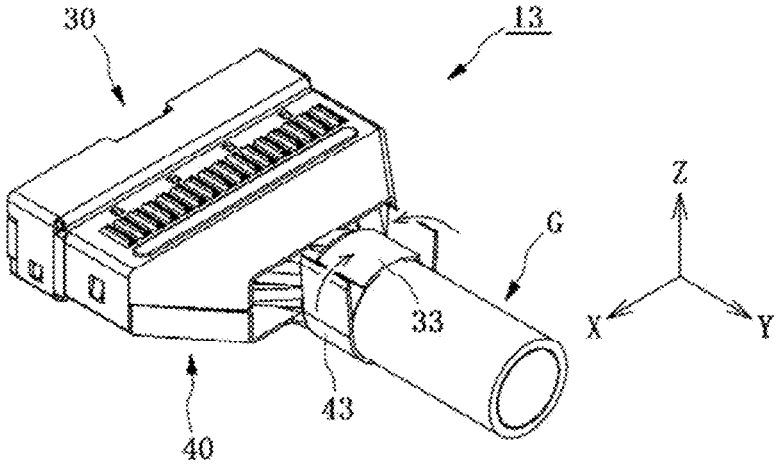
FIG. 22 is a drawing (part 8) intended to explain steps of producing the connector.

Next, as illustrated in FIGS. 20 and 21, the top shell 30 is attached to the sub-assembly 12 to connect the conductive member 80 to the top shell 30. Specifically, the top shell 30 is moved along the Z-axis direction so that the first protrusion 81 is fitted into the support hole 31 in the top shell 30. As a result, the first protrusion 81 comes into contact with the resilient pieces 32 protruding from an edge of the support hole 31, allowing electrical continuity to be established. Through this step, the conductive member 80 is electrically connected to the top shell 30, with the result that the outer conductor C3 of the coaxial cable C is electrically connected to the top shell 30.

(Step of Attaching Bottom Shell 40)

Then, the bottom shell 40 is attached to the sub-assembly 12 to connect the conductive member 80 to the bottom shell 40. Specifically, the bottom shell 40 is moved along the Z-axis direction so that the first protrusion 81 is fitted into the support hole 41 in the bottom shell 40. As a result, the first protrusion 81 comes into contact with the resilient pieces 42 protruding from an edge of the support hole 41, allowing electrical continuity to be established. Through this step, the conductive member 80 is electrically connected to the bottom shell 40, with the result that the outer conductor C3 of the coaxial cable C is electrically connected to the bottom shell 40. After the steps of attaching the top and bottom shells 30 and 40, the sub-assembly 13 illustrated in FIG. 22, in which the top and bottom shells 30 and 40 are attached, is obtained.

(Step of One-Time Swaging)

Next, the ends 33 and 43 of the top and bottom shells 30 and 40, respectively, are swaged onto the circumference of the cables group G. Through this step, the top shell 30 at its end 33 and the bottom shell 40 are fixed to the cables group G.

(Step of Attaching Outer Housing 20)

Figure 23:
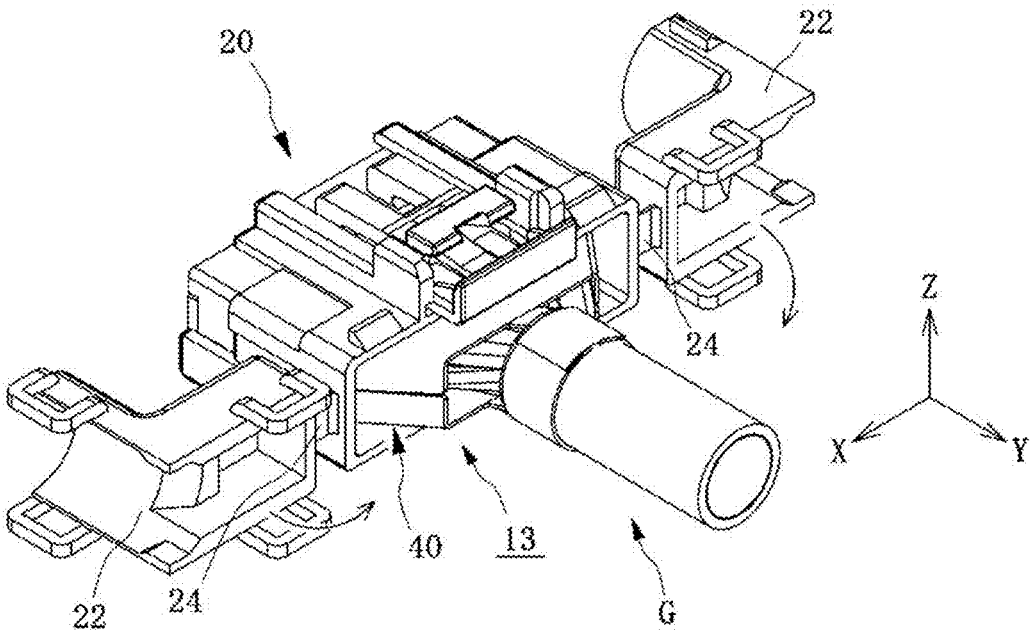
FIG. 23 is a drawing (part 9) intended to explain steps of producing the connector.

Next, the outer housing 20 is attached to the sub-assembly 13 as illustrated in FIG. 23. The cable covers 22 are each rotated on a rotation axis of the hinge 24 and attached to the sub-assembly from either side of the cables group G. Through this step, the outer housing 20 is fixed to the cables group G. The connector 10 illustrated in FIG. 1 is now produced.

As described above, according to the Embodiment 1, the conductive member 80 is crimped and fixed onto the outer conductor C3 of the coaxial cable C, as seen in FIG. 11. Thus, the conductive member 80 and the outer conductor C3 of the coaxial cable C can be connected more easily than, for example, joining the conductive member 80 and the outer conductor C3 through soldering. As a result, the work efficiency in the step of assembling the connector 10 can be improved.

In general, a car-mounted connector is used in an environment with severe temperature and humidity conditions and higher-frequency vibrations. The conductive member 80 of the connector 10 according to the Embodiment 1 is crimped and fixed onto the outer conductor C3 of the coaxial cable C, which eliminates possibilities of cracks or degradation that may be caused in a soldered portion, thus preventing deterioration of electrical continuity in the connector 10. Therefore, the Embodiment 1 improves the connection reliability of the connector 10 and stabilizes its quality.

In the Embodiment 1, in addition to the conductive member 80, the terminal 70 is crimped and fixed onto the inner conductor C1 of the coaxial cable C. Thus, all the connecting portions throughout the connector 10 can be joined in a solderless manner. As a result, both the work efficiency in the step of assembling the connector 10 and the connection reliability of the connector 10 can be improved.

In the Embodiment 1, as illustrated in FIG. 14, the second protrusion 82 of the conductive member 80 is fitted into the support hole 64 in the center shell 60. Thus, the conductive member 80 and the center shell 60 can be easily connected. As a result, the work efficiency in the step of assembling the connector 10 can be improved.

In the Embodiment 1, the first protrusion 81 of the conductive member 80 is fitted into the support hole 31 or 41 in the top shell 30 or bottom shell 40, so that the conductive member 80 is supported. Thus, the conductive member 80 can be easily connected to either of the top and bottom shells 30 and 40. As a result, the work efficiency in the step of assembling the connector 10 can be improved.

Embodiment 2

A connector 10A and a production method thereof according to Embodiment 2 of the present disclosure will now be described with reference to FIGS. 24 to 28. For ease of understanding, the description about the Embodiment 2 below focuses on differences from the Embodiment 1, while giving identical symbols to components in common with the Embodiment 1 and omitting their descriptions.

Figure 24:
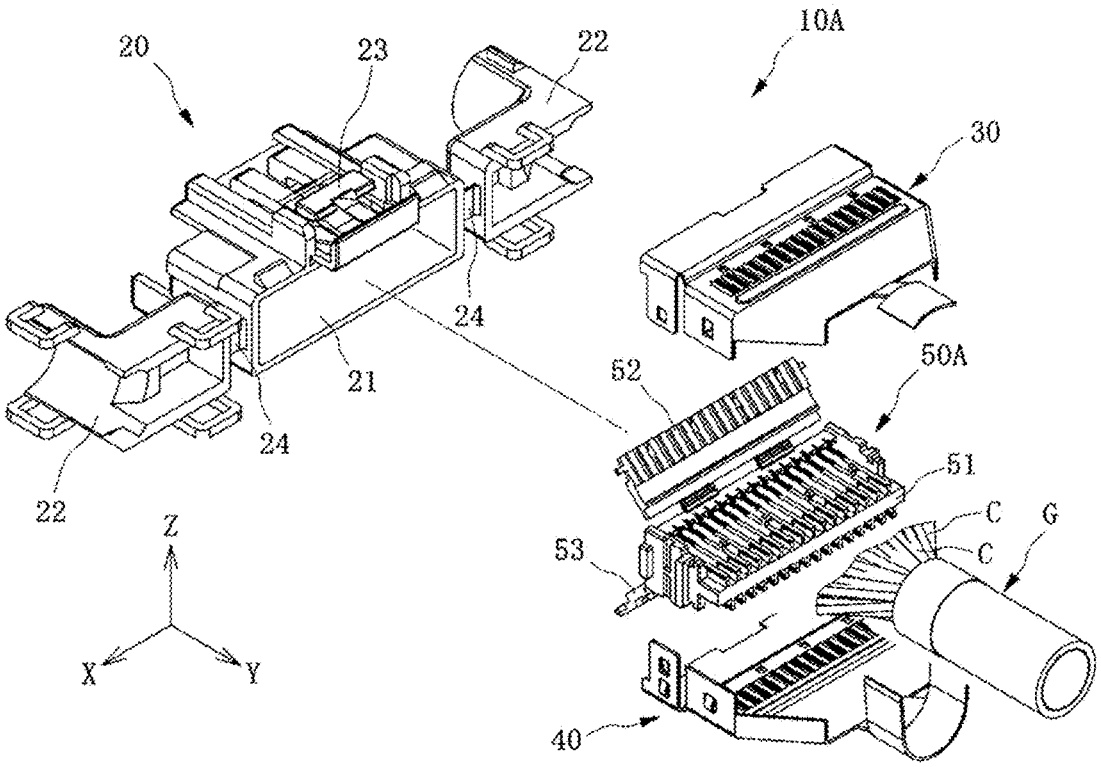
FIG. 24 is an exploded perspective view of a connector according to Embodiment 2 of the present disclosure.
Figure 25:
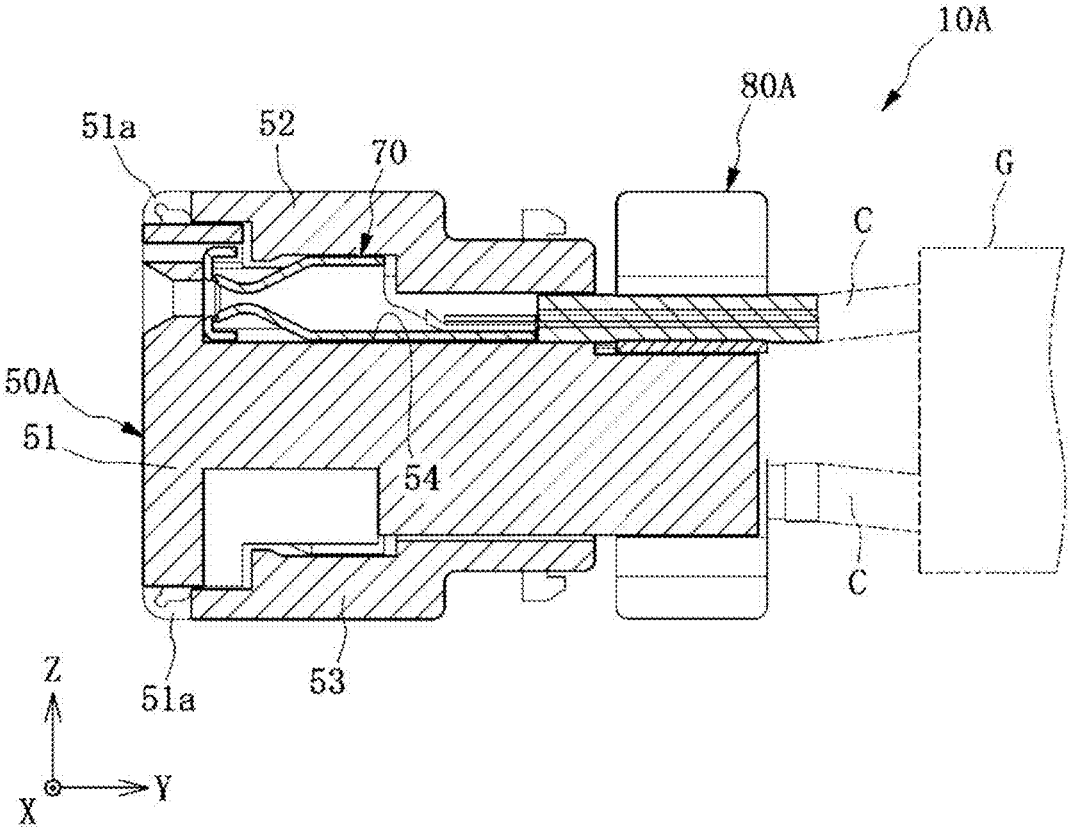
FIG. 25 is a YZ cross-sectional view of the connector according to Embodiment 2.

The connector 10A, which is illustrated in FIGS. 24 and 25, is different from the connector 10 of the Embodiment 1 in that the center shell 60 (third shell) is absent. The connector 10A includes an outer housing 20, a top shell 30, a bottom shell 40, an inner housing 50A, a terminal 70, and a conductive member 80A. Members except the inner housing 50A and the conductive member 80A are the same as those in the Embodiment 1. For ease of understanding, FIG. 24 omits part of the coaxial cable C.

The inner housing 50A, which is made of an electrically insulative material such as a resin, is different from the inner housing of the Embodiment 1 in that the center shell housing chamber is not formed. As in the Embodiment 1, the inner housing 50A includes an inner housing body 51 and an upper cover 52 and a lower cover 53 that are rotatably attached to the inner housing body 51 via a hinge 51*a*. In the inner housing body 51, thirty-two terminal housing chambers 54 in total are formed in two rows and sixteen columns.

Figure 26:
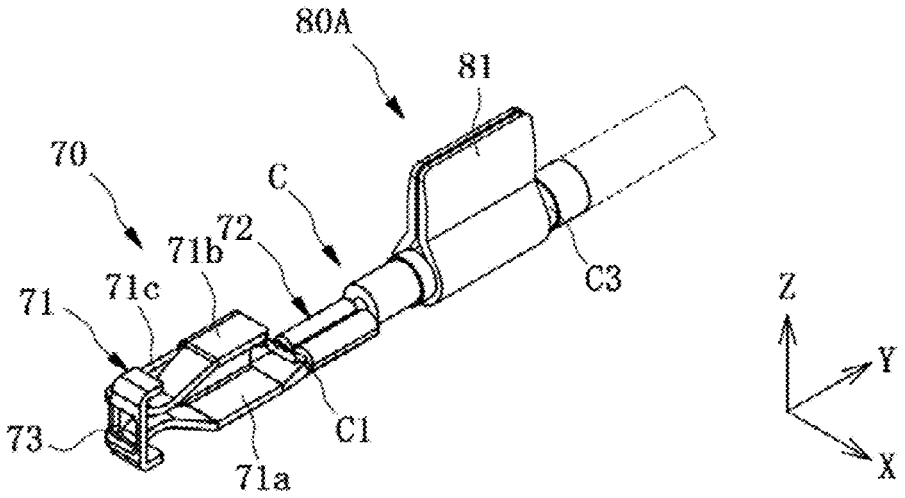
FIG. 26 is a perspective view (part 1) of a terminal, a conductive member, and a tip of the connector according to Embodiment 2.
Figure 27:
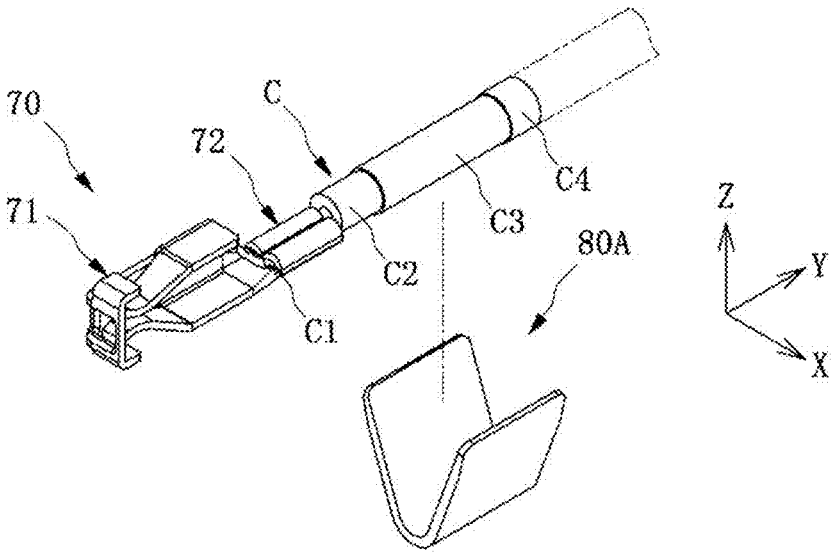
FIG. 27 is a perspective view (part 2) of the terminal, the conductive member, and the tip of the connector according to Embodiment 2.

As illustrated in FIGS. 26 and 27, the conductive member 80A is a metal crimp terminal to be crimped and fixed onto the outer conductor C3 of the coaxial cable C. The conductive member 80A, which is formed by bending an electrically conductive plate made from copper, a copper alloy, or the like, is different from the conductive member of the Embodiment 1 in that the second protrusion 82 is not formed. The conductive member 80A includes a first protrusion 81 that is to come into contact with the top shell 30 or the bottom shell 40. The first protrusion 81 protrudes in the Z-axis direction, which is orthogonal to the direction in which the terminal 70 extends. The first protrusion 81 is formed by putting together plate-like ends of the conductive member 80A that is not attached to the outer conductor C3 of the coaxial cable C yet.

Figure 28:
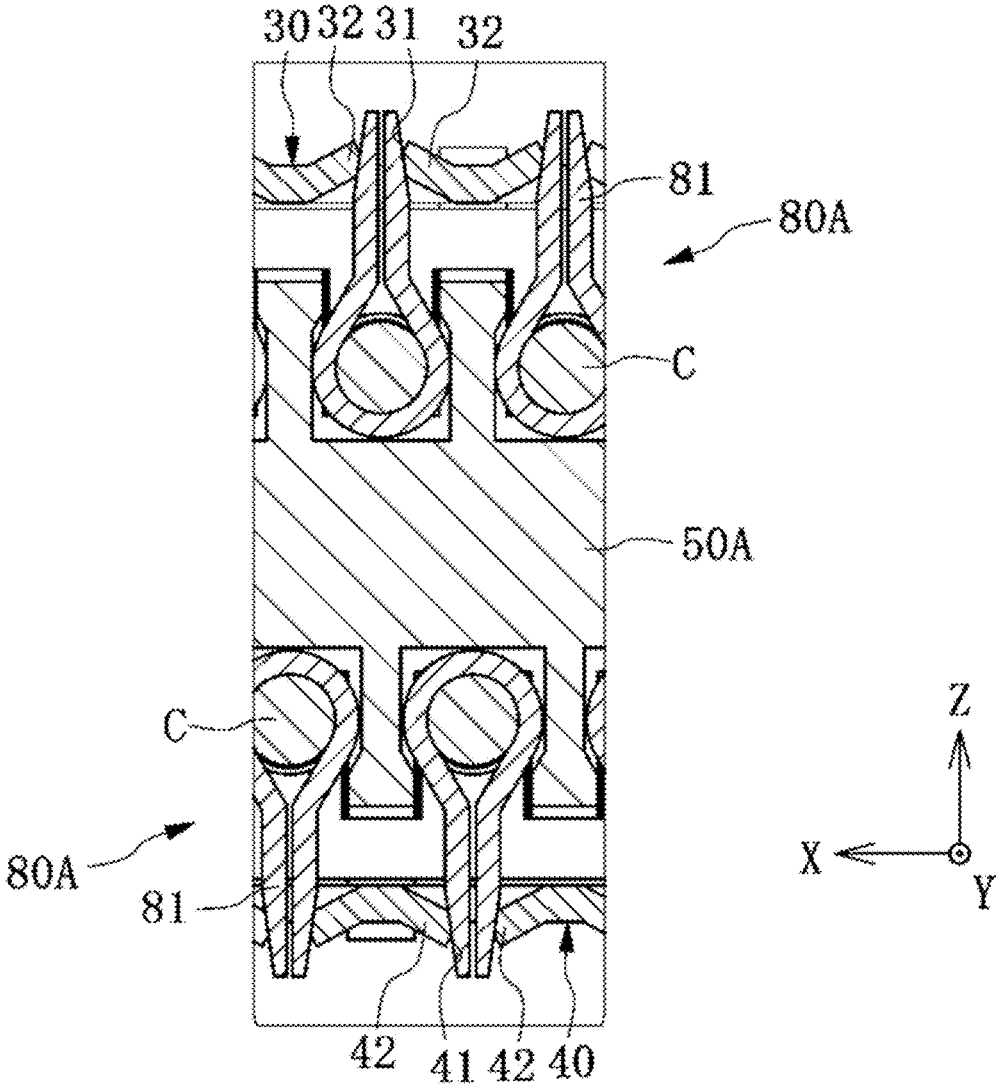
FIG. 28 is an XZ cross-sectional view of the connector according to Embodiment 2.

As illustrated in FIG. 28, the first protrusion 81 is formed to protrude in the Z-axis direction (in the +Z or −Z direction). Specifically, the conductive member 80A disposed in the upper row has the first protrusion 81 protruding in the +Z direction, while the conductive member 80A disposed in the lower row has the first protrusion 81 protruding in the −Z direction. The first protrusion 81 is supported by the top shell 30 or the bottom shell 40 with the first protrusion 81 fitted into the support hole 31 in the top shell 30 or into the support hole 41 in the bottom shell 40. Resilient pieces 32 and 42 are protruding from an edge of the support holes 31 and 41 to come into contact with the first protrusion 81 fitted into either the support hole 31 or 41, allowing electrical continuity to be established. As a result, the conductive member 80A is connected to the top shell 30 or the bottom shell 40, allowing electrical continuity to be established.

As described above, the Embodiment 2 also allows the conductive member 80A to be crimped and fixed onto the outer conductor C3 of the coaxial cable C, and thus the conductive member 80A and the outer conductor C3 of the coaxial cable C can be connected easily as in the Embodiment 1. As a result, the work efficiency in the step of assembling the connector 10A can be improved.

The conductive member 80A according to the Embodiment 2 is crimped and fixed onto the outer conductor C3 of the coaxial cable C. Thus, even when the connector 10A is used as a car-mounted connector in an environment with severe temperature and humidity conditions and higher-frequency vibrations, possibilities of cracks or degradation that may be caused in a soldered portion are eliminated, thereby preventing deterioration of electrical continuity in the connector 10A. Therefore, the Embodiment 2 improves the connection reliability of the connector 10A and stabilizes its quality.

In the Embodiment 2, in addition to the conductive member 80A, the terminal 70 is crimped and fixed onto the inner conductor C1 of the coaxial cable C. Thus, all the connecting portions throughout the connector 10A can be joined in a solderless manner. As a result, both the work efficiency in the step of assembling the connector 10A and the connection reliability of the connector 10A can be improved.

In the Embodiment 2, the first protrusion 81 of the conductive member 80A is fitted into the support hole 31 or 41 in the top shell 30 or bottom shell 40, so that the conductive member 80A is supported. Thus, the conductive member 80A can be easily connected to either of the top and bottom shells 30 and 40. As a result, the work efficiency in the step of assembling the connector 10A can be improved.

Embodiments of the present disclosure have been described above, but the present disclosure is not limited to the foregoing first and Embodiment 2s.

Embodiment 3

Figure 29A:
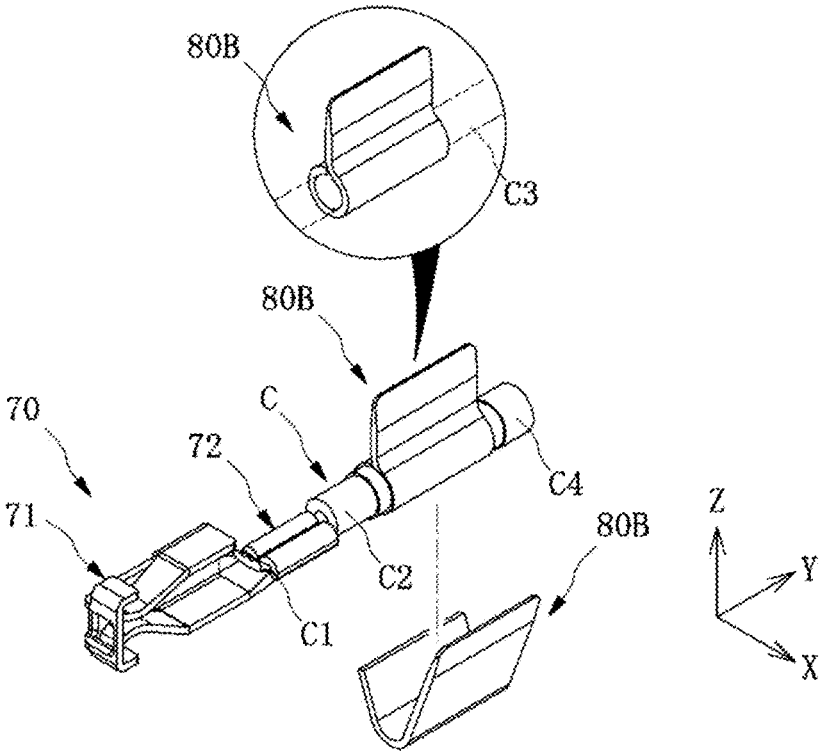
FIG. 29A is a perspective view (part 1) of a terminal, a conductive member, and a tip of a connector according to Embodiment 3.
Figure 29B:
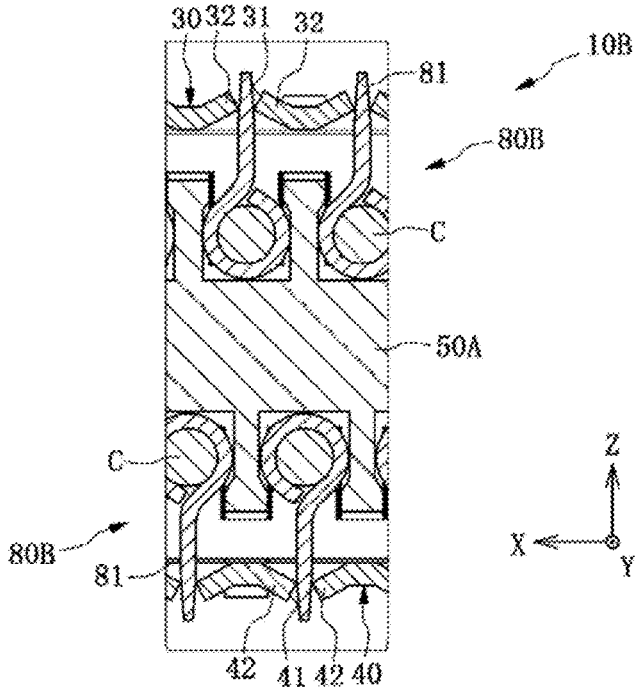
FIG. 29B is an XZ cross-sectional view of the connector according to Embodiment 3.

For example, the conductive members 80 and 80A according to the foregoing first and Embodiment 2s include the first protrusion 81, which is formed by putting plate-like ends of the conductive member 80 or 80A together before the conductive member is attached to the outer conductor C3 of the coaxial cable C, as illustrated in FIGS. 11 and 26. However, this is not restrictive. For example, the first protrusion 81 may be formed in such a way that plate-like ends of the conductive member 80B are not put together before attached to the outer conductor C3 of the coaxial cable C, as in the connector 10B illustrated in FIGS. 29A and 29B. In this case, before the conductive member 80B is attached to the outer conductor C3 of the coaxial cable C, the first protrusion 81 is formed by wrapping one plate-like end of the conductive member 80B around the coaxial cable C and then protruding the other end.

Embodiment 4

Figure 30A:
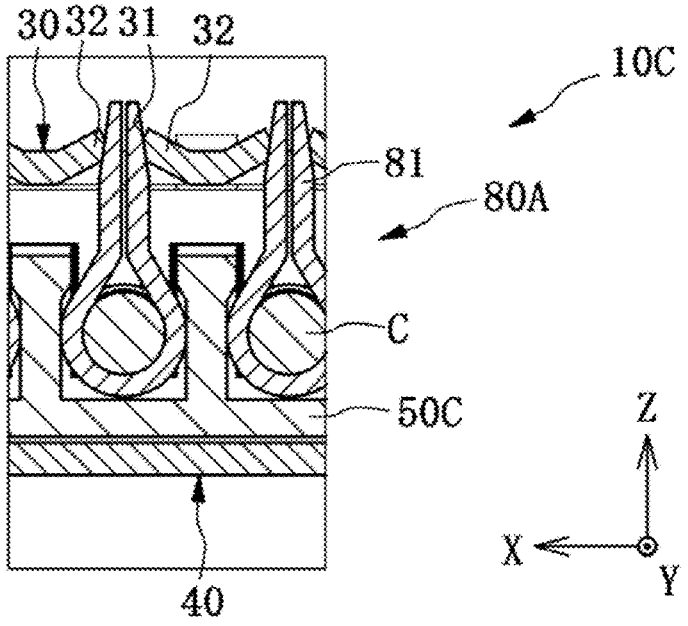
FIG. 30A is an XZ cross-sectional view of a connector according to Embodiment 4.
Figure 30B:
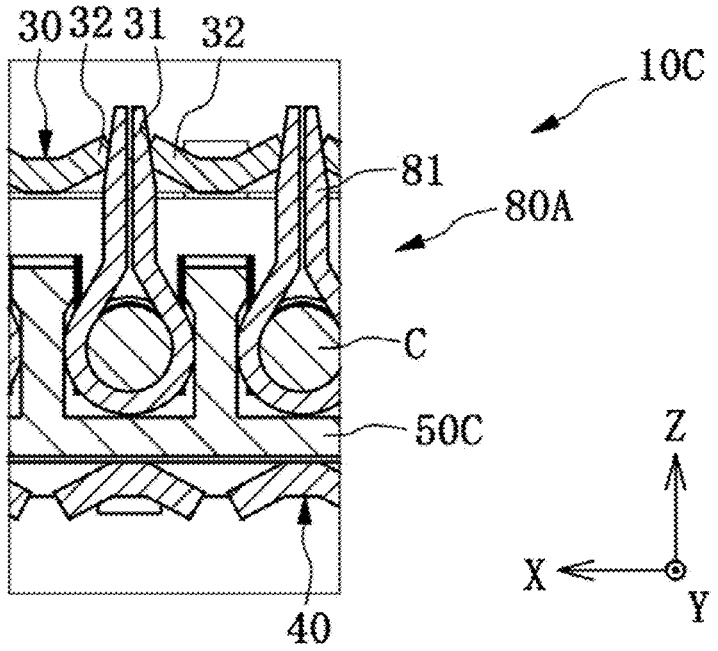
FIG. 30B is an XZ cross-sectional view of a connector according a variation of Embodiment 4.

The connector 10 according to the foregoing embodiments include the terminals 70 and conductive members 80 arranged in two rows. However, this is not restrictive, and thus the terminals 70 and conductive members 80 may be arranged in, for example, one row or three rows. In the case where the terminals 70 and conductive members 80 are arranged in one row, the connector 10C includes, as illustrated in FIGS. 30A and 30B, a top shell 30, a bottom shell 40, and an inner housing 50C, without a center shell. In the Embodiment 4, the connector 10C employs the conductive member 80A where the second protrusion 82 is not formed. As seen by comparing FIG. 30A with FIG. 30B, the support hole 41 may or may not be formed in the bottom shell 40.

Embodiment 5

Figure 31:
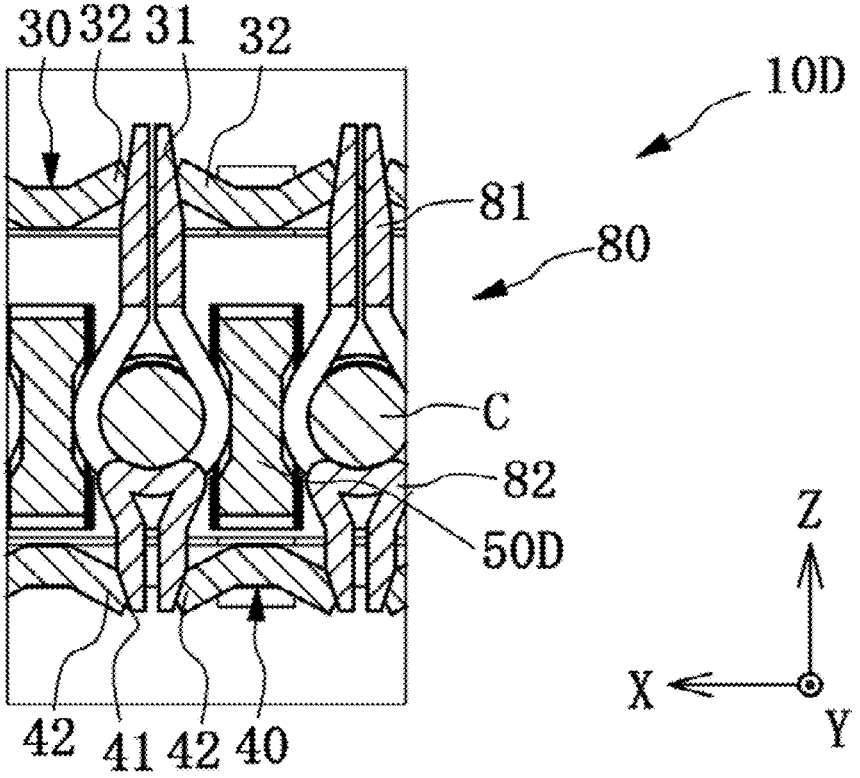
FIG. 31 is an XZ cross-sectional view of a connector according to Embodiment 5.

The connector 10 according to the foregoing embodiments include the terminals 70 and conductive members 80 arranged in two rows. However, this is not restrictive, and thus the terminals 70 and conductive members 80 may be arranged in, for example, one row or three rows. In the case where the terminals 70 and conductive members 80 are arranged in one row, the connector 10D includes, as illustrated in FIG. 30A, 30B, or 31, a top shell 30, a bottom shell 40, and an inner housing 50D, without a center shell. In Embodiment 5, the connector 10D employs the conductive member 80 where the second protrusion 82 is formed.

Descriptions in the foregoing Embodiment 1 assume that the top shell 30 is the "first shell" of the present disclosure. However, the bottom shell 40 may be the "first shell" of the present disclosure instead.

The "second shell" according to claim 6 as filed corresponds to any one of the bottom shell 40 and the center shell 60 according to the first, second, fourth, and Embodiment 5s. The "second shell" according to claim 7 as filed corresponds to the center shell 60 according to the Embodiment 1 and to the bottom shell 40 according to the Embodiment 5. The "second shell" according to claim 7 as filed corresponds to nothing in the second or Embodiment 4.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A connector comprising:

an electrically conductive first terminal that is crimped and fixed onto an inner conductor of a coaxial cable;

an electrically conductive first conductive member that is crimped and fixed onto an outer conductor of the coaxial cable;

an electrically insulative housing that comprises a first housing chamber housing the first terminal and the first conductive member; and an electrically conductive first shell to which the first conductive member being housed is connected and which is configured as at least one of a ground and a shield, wherein a first protrusion that comes into contact with the first shell is disposed in the first conductive member, and a first support hole is formed in the first shell, the first support hole supporting the first conductive member with the first protrusion fitted into the first support hole.

2. The connector according to claim 1, wherein the first terminal has a shape extending from a joint portion where a counterpart terminal is connected to a crimp portion where the terminal is crimped onto the coaxial cable, and the first protrusion protrudes in a direction being orthogonal to a direction in which the first terminal extends.

3. The connector according to claim 1, wherein the first conductive member comprises an electrically conductive plate material, which is wrapped around the outer conductor of the coaxial cable, and a pair of ends of which are put together and protrude from the outer conductor, and the first protrusion comprises a portion where the pair of ends are put together.

4. The connector according to claim 1, wherein the first conductive member comprises an electrically conductive plate material, which is wrapped around the outer conductor of the coaxial cable, and one end of which protrudes from the outer conductor, and the first protrusion comprises a portion where the one end protrudes.

5. The connector according to claim 1, comprising an electrically conductive second shell that is configured as at least one of a ground and a shield.

6. The connector according to claim 5, wherein a second protrusion that comes into contact with the second shell is disposed in the first conductive member, a second support hole is formed in the second shell, the second support hole supporting the first conductive member with the second protrusion fitted into the second support hole, and the first conductive member is connected to the second shell with the second protrusion fitted into the second support hole.

7. The connector according to claim 1, comprising:

an electrically conductive second terminal that is crimped and fixed onto an inner conductor of another coaxial cable;

an electrically conductive second conductive member that is crimped and fixed onto an outer conductor of the other coaxial cable; and an electrically conductive second shell to which the second conductive member is connected and which is configured as at least one of a ground and a shield, wherein the housing is formed into a plate-like shape comprising a first face on which the first housing chamber is disposed and a second face being opposite to the first face, and the housing comprises a second housing chamber on the second face, the second housing chamber housing the second terminal and the second conductive member.

8. The connector according to claim 7, comprising an electrically conductive third shell to which the first conductive member and the second conductive member are connected and which is configured as a ground.

9. The connector according to claim 8, wherein a second protrusion that comes into contact with the third shell is disposed in the first conductive member, and a third support hole is formed in the third shell, the third support hole supporting the first conductive member with the second protrusion fitted into the third support hole.

10. The connector according to claim 9, wherein the first conductive member comprises an electrically conductive plate material, which is wrapped around the outer conductor of the coaxial cable and which includes two tongue-like cuts, and the second protrusion is formed by putting together ends of raised tongue-like portions.

11. The connector according to claim 8, wherein the third shell is press-fitted into the housing and fixed in the housing.

12. A method for producing a connector, the method comprising:

a terminal crimping step of crimping and fixing an electrically conductive first terminal onto an inner conductor of a coaxial cable;

a conductive member crimping step of crimping and fixing an electrically conductive first conductive member onto an outer conductor of the coaxial cable;

a housing step of housing the first terminal and the first conductive member into a first housing chamber of a housing that comprises an electrically conductive third shell configured as a ground; and a ground connecting step of connecting the first conductive member to the third shell, wherein in the conductive member crimping step, a second protrusion that comes into contact with the third shell is formed in the first conductive member, a third support hole is formed in the third shell, the third support hole supporting the first conductive member with the second protrusion fitted into the third support hole, the first terminal has a shape extending from a joint portion where a counterpart terminal is connected to a crimp portion where the terminal is crimped onto the coaxial cable, and the second protrusion protrudes in a direction being orthogonal to a direction in which the first terminal extends, and in the ground connecting step, the second protrusion is fitted into the third support hole, with the second protrusion and the third support hole being moved relative to each other in the orthogonal direction.

13. A connector comprising:

an electrically conductive first terminal that is crimped and fixed onto an inner conductor of a coaxial cable;

an electrically conductive first conductive member that is crimped and fixed onto an outer conductor of the coaxial cable;

an electrically insulative housing that comprises a first housing chamber housing the first terminal and the first conductive member;

an electrically conductive first shell to which the first conductive member being housed is connected and which is configured as at least one of a ground and a shield, and an electrically conductive third shell that is configured as at least one of a ground and a shield, wherein a second protrusion that comes into contact with the third shell is disposed in the first conductive member, a third support hole is formed in the third shell, the third support hole supporting the first conductive member with the second protrusion fitted into the third support hole, and the first conductive member is connected to the third shell with the second protrusion fitted into the third support hole.

* * * * *